US008651168B2

(12) United States Patent
Thomas et al.

(10) Patent No.: US 8,651,168 B2
(45) Date of Patent: Feb. 18, 2014

(54) COOLING CONTROL SYSTEM FOR CONTINUOUS CASTING OF METAL

(75) Inventors: Brian G. Thomas, Champaign, IL (US); Joseph Bentsman, Urbana, IL (US); Kai Zheng, Highland, IN (US)

(73) Assignee: Board of Trustees of the University of Illinois, Urbana, IL (US)

( * ) Notice: Subject to any disclaimer, the term of this patent is extended or adjusted under 35 U.S.C. 154(b) by 0 days.

(21) Appl. No.: 13/467,709

(22) Filed: May 9, 2012

(65) Prior Publication Data

US 2013/0068416 A1 Mar. 21, 2013

Related U.S. Application Data

(63) Continuation of application No. 12/151,582, filed on May 7, 2008, now abandoned.

(60) Provisional application No. 60/928,043, filed on May 7, 2007.

(51) Int. Cl.
*B22D 11/22* (2006.01)

(52) U.S. Cl.
USPC ..... 164/455; 164/452

(58) Field of Classification Search
USPC ..... 164/452, 454, 455, 485, 486
See application file for complete search history.

(56) References Cited

U.S. PATENT DOCUMENTS 3,478,808 A 11/1969 Adams
4,006,633 A 2/1977 Shipman et al.
4,024,764 A 5/1977 Shipman et al.
4,073,332 A 2/1978 Etienne (Continued)

FOREIGN PATENT DOCUMENTS

| | | |
|---|---|---|
| JP | 01271049 | 10/1989 |
| JP | 10128514 | 5/1998 |
| JP | 2002079356 | 3/2002 |
| WO | 03023074 | 3/2003 |

OTHER PUBLICATIONS

Spitzer, K.H., et al.; Mathematical Model for Thermal Tracking and On-line Control in Continuous Casting, ISIJ International, vol. 32 (1992), No. 7, pp. 848-856.

(Continued)

*Primary Examiner* — Kevin P Kerns
*Assistant Examiner* — Jacky Yuen
(74) *Attorney, Agent, or Firm* — Krieg DeVault LLP

(57) ABSTRACT

Maintaining the shell surface temperature profile under transient conditions by spray water cooling in continuous casting of steel is often desired to reduce occurrence of surface cracks. For this purpose, a real-time spray-cooling control system is provided that includes one or more of: a virtual sensor for accurate estimation/prediction of shell surface temperature, control algorithm and data checking subroutines for robust temperature control, server and client programs for communicating between these software components and the caster, and a real-time monitor to display the predicted shell surface temperature profiles, water flow rates, and operating data, among other things.

25 Claims, 17 Drawing Sheets

(56) References Cited

U.S. PATENT DOCUMENTS

| | | | | |
|---|---|---|---|---|
| 4,463,795 | A * | 8/1984 | Chielens et al. | 164/455 |
| 4,562,880 | A | 1/1986 | Larrecq et al. | |
| 4,699,202 | A | 10/1987 | Gilles | |
| 5,509,460 | A | 4/1996 | Chun et al. | |
| 5,634,512 | A | 6/1997 | Bombardelli et al. | |
| 5,665,181 | A | 9/1997 | Rohde | |
| 5,854,749 | A | 12/1998 | Kellams et al. | |
| 5,988,259 | A * | 11/1999 | Welker et al. | 164/455 |
| 6,225,609 | B1 | 5/2001 | Imanari et al. | |
| 6,557,622 | B2 | 5/2003 | Frank et al. | |
| 6,835,253 | B1 | 12/2004 | Kawalla et al. | |
| 6,880,616 | B1 | 4/2005 | Kemna et al. | |
| 6,885,907 | B1 | 4/2005 | Zhang et al. | |
| 7,156,148 | B2 | 1/2007 | Iizuka et al. | |
| 2002/0050336 | A1 | 5/2002 | Ebisu et al. | |
| 2002/0117290 | A1 | 8/2002 | Ebisu et al. | |

OTHER PUBLICATIONS

Hardin, R., et al.; A Transient Simulation and Dynamic Spray Cooling Control Model for Continuous Steel Casting, Metallurgical and Materials Trans. B, V. 34B, Jun. 20, 2003, 297-306.

Kiflie, B, et al., Thermal Analysis of Continuous Casting Process, ESME 5th Annual Conference on Manufacturing and Process Industry, Sep. 2000.

Meng, Y., et al.; Heat Transfer and Solidification Model of Continuous Slab Casting: CON1D; Metallurgical and Materials Trans. B, V. 34B, No. 5, Oct. 2003, pp. 685-705.

Introduction to Continuous Casting, Continuous Casting Consortium, http://ccc.me.uiuc.edu/introduction/overview.html.

Control System Design—Simulations, Rolling Mill Shape Control—Part 2, <http://irepco.com/modern/shape%20control/Control%20System%20Design%20-%20Simulations.htm>, Internet archive dated Jan. 15, 2007.

* cited by examiner

COOLING CONTROL SYSTEM FOR CONTINUOUS CASTING OF METAL

CROSS-REFERENCE TO RELATED APPLICATIONS

The present application is a continuation of U.S. patent application Ser. No. 12/151,582, filed on May 7, 2008, now abandoned which claims the benefit of U.S. Provisional Patent Application No. 60/928,043, filed May 7, 2007, both of which are herein incorporated by reference in their entirety.

FEDERALLY SPONSORED RESEARCH OR DEVELOPMENT

The present invention was made with Government assistance under National Science Foundation (NSF) Grant DMI 05-00453.

BACKGROUND

The present application relates to metal casting, and more particularly, but not exclusively, relates to the continuous casting of metal slabs and cooling control thereof.

Typical continuous casting arrangements include a water-cooled mold that provides initial/primary cooling of the molten metal being cast. Robust and accurate control of secondary cooling, such as water spray cooling, with such arrangements is often desired for successful operation and the production of high quality products. Secondary cooling is often a focus of thin slab casters because high casting speed and a tight machine radius typically require carefully-prescribed temperature profiles to avoid various problems, such as cracks and "whale formation". Indeed, cracking can be reduced by successful control of the secondary cooling to maintain these optimal temperature profiles through changes in casting process conditions. Whale formation can be avoided by ensuring that the metallurgical length (maximum length of the liquid core of the continuous-cast metal) is always less than the length of that portion of the caster where support rolls contain the strand to prevent excessive bulging.

Secondary cooling presents several challenges to control. Conventional feedback control systems based on hardware sensors are typically unsuccessful because emissivity variations from intermittent surface scale and the harsh environment of the steam-filled spray chamber makes optical pyrometers unreliable. Secondary cooling of thin-slab casting is particularly difficult to control because of the thinner shell, the higher casting speed, and the increased relevance of solidification in the mold, which is not easy to predict accurately. Thus, there is a need for further contributions in this area of technology.

SUMMARY

One embodiment of the present invention includes a unique casting technique. Other embodiments include unique methods, systems, devices, and apparatus involving continuous casting control. Further embodiments, forms, features, aspects, benefits, and advantages of the present application shall become apparent from the description and figures provided herewith.

DETAILED DESCRIPTION OF REPRESENTATIVE EMBODIMENTS

Figure 1:
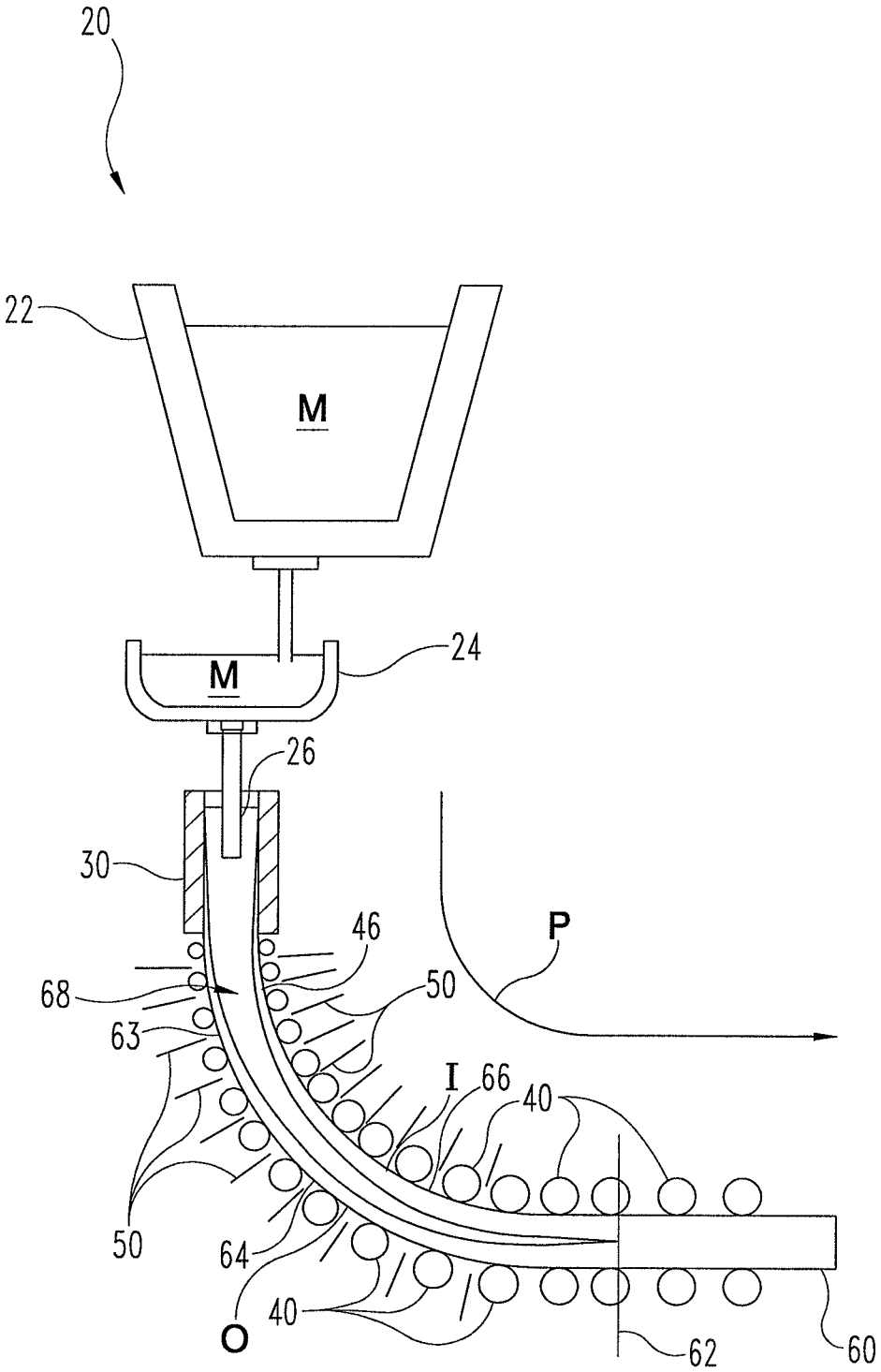
FIG. 1 is a partial diagrammatic view of a continuous caster.

For the purposes of promoting an understanding of the principles of the invention, reference will now be made to the embodiments illustrated in the drawings and specific language will be used to describe the same. It will nevertheless be understood that no limitation of the scope of the invention is thereby intended. Any alterations and further modifications in the described embodiments, and any further applications of the principles of the invention as described herein are contemplated as would normally occur to one skilled in the art to which the invention relates.

In one embodiment of the present application, a continuously cast strand is characterized with a shell temperature/solidification model, yielding control-oriented real-time shell temperature profile estimates and predictions. This model is further referred to as a software (virtual) sensor that is based on a computational model designated as CON1D. By way of background, additional information about this model is provided in Y. Meng and B. G. Thomas, "Heat-Transfer and Solidification Model of Continuous Slab Casting: CON1D," Metallurgical and Materials Transactions, Vol. 34B (October 2003), which is hereby incorporated by reference in its entirety. With such modeling, independently tuned controllers are provided to maintain the shell surface temperature profile at the desired setpoint for different casting speeds and different grades such that casting problems are reduced. Based on the software sensor and the controllers, a spray cooling control system is regulated. Further, a visual monitor interface facilitates real-time monitoring of the shell surface temperature predictions, the predicted metallurgical length, control commands, and various casting conditions.

Figure 8:
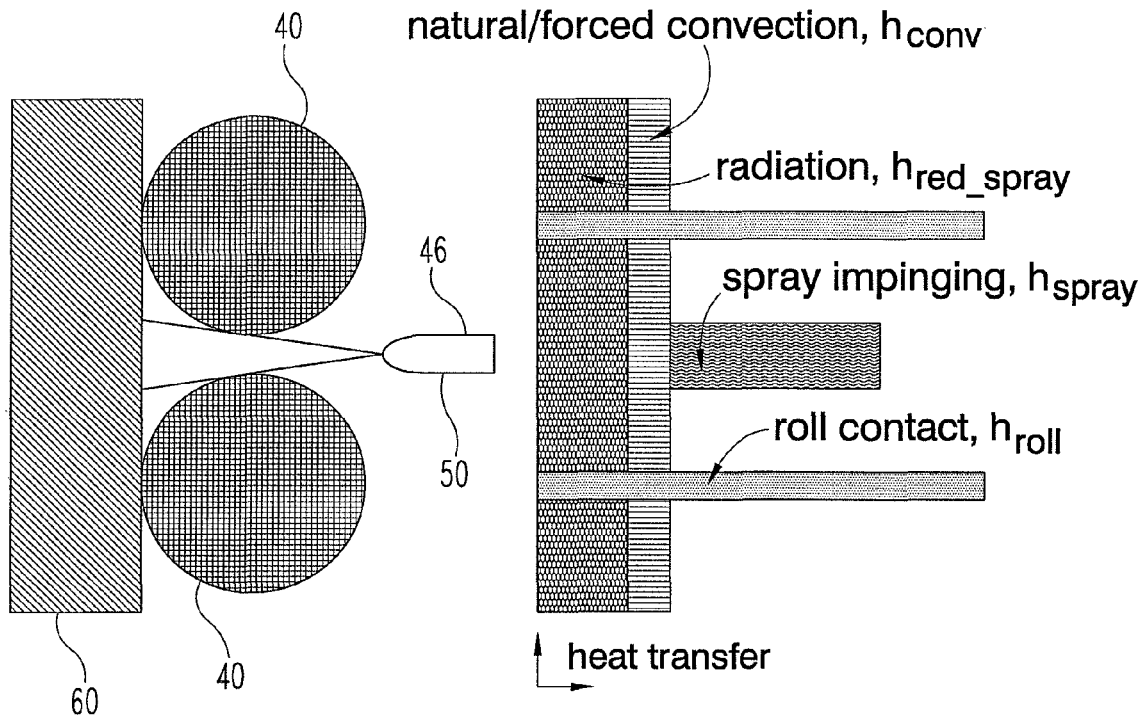
FIG. 8 is a comparative diagram illustrating strand heat transfer aspects associated with representative rolls and a cooling fluid discharge device of the caster of FIG. 1.

FIG. 1 further depicts thin-slab continuous caster 20 as one embodiment of the present application. Caster 20 includes source 22 of molten metal M that is supplied to tundish 24. Molten metal M is typically a steel alloy formulation, but may be a different metal/alloy as would occur to those skilled in the art. Tundish 24 provides molten metal M to mold 30 via a submerged outlet, forming meniscus 26 at the top of mold 30. Mold 30 is depicted in section. Thermal transfer from molten metal M to coolant flow F shown in FIG. 2 results in the formation of metallic strand 60 that is withdrawn from mold 30 by a number of rolls 40 along a cooling pathway P that curves from vertical to horizontal. A number of cooling fluid discharge devices 50 are placed between rolls 40 along pathway P. Devices 50 are in the form of spray nozzles 46, which discharge fluid, such as mixtures of water and/or air-water mist. In FIG. 1, only a few of devices 50 and rolls 40 are designated by reference numerals to preserve clarity. FIG. 8 schematically depicts a representative spray nozzle 46 relative to two rolls 40 and strand 60 in greater detail.

Figure 9:
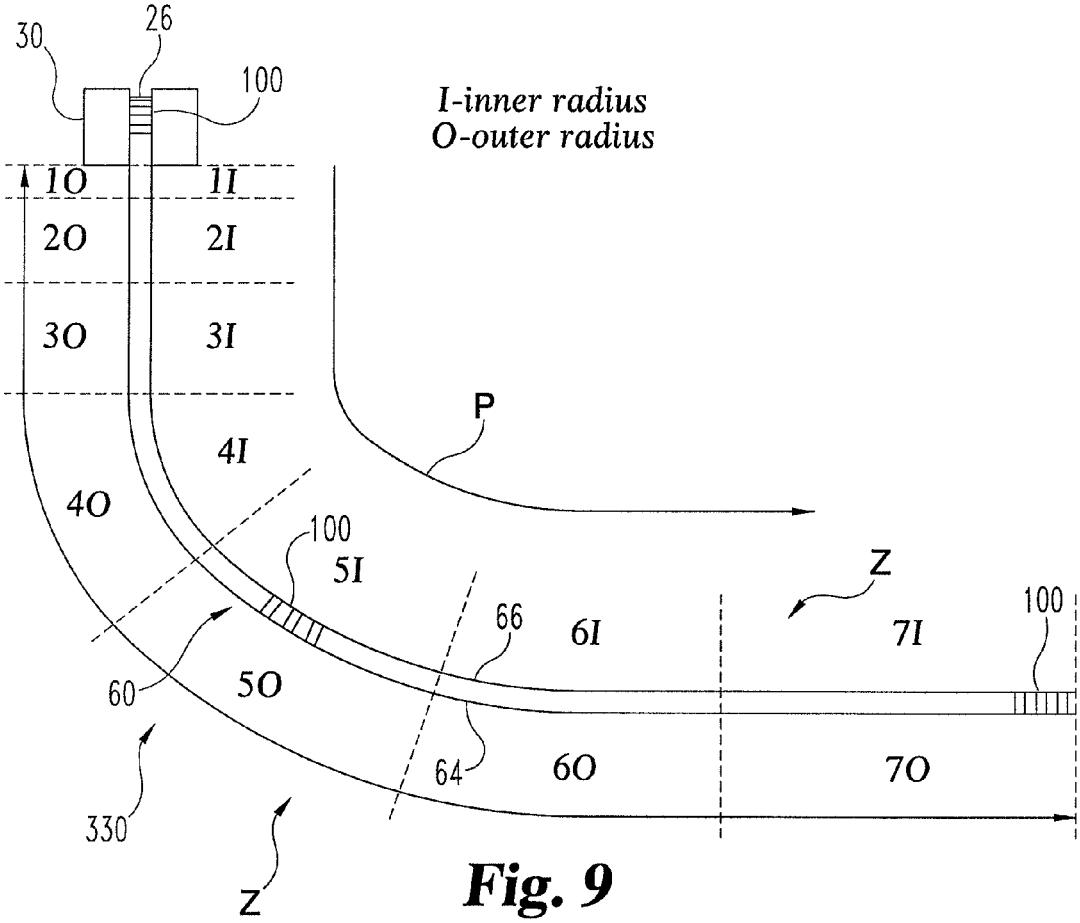
FIG. 9 is a diagram illustrating various cooling zones for the caster of FIG. 1.

Formation of strand 60 begins with the solidification of an outer shell 63 in mold 30. The thickness of shell 63 increases as strand 60 cools along pathway P until it is completely solid corresponding to metallurgical length 62 along pathway P. From mold 30 to metallurgical length 62, shell 63 contains an unsolidified metal pool 68. Bounding pool 68, strand 60 has a shell side 64 along its outer radius O and a shell side 66 along its inner radius I for the curved arrangement of pathway P. Pool 68 is indicated by converging solid lines between mold 30 and metallurgical length 62 in FIG. 1 and by converging dotted lines representing the solidification front in FIG. 2. For the depicted embodiment, cooling fluid discharge devices 50 are positioned along pathway P to define a number of spray cooling zones Z designated in terms of inner and outer radii (I and O) as shown in FIG. 9 (where like reference numerals refer to like features previously described).

Figure 2:
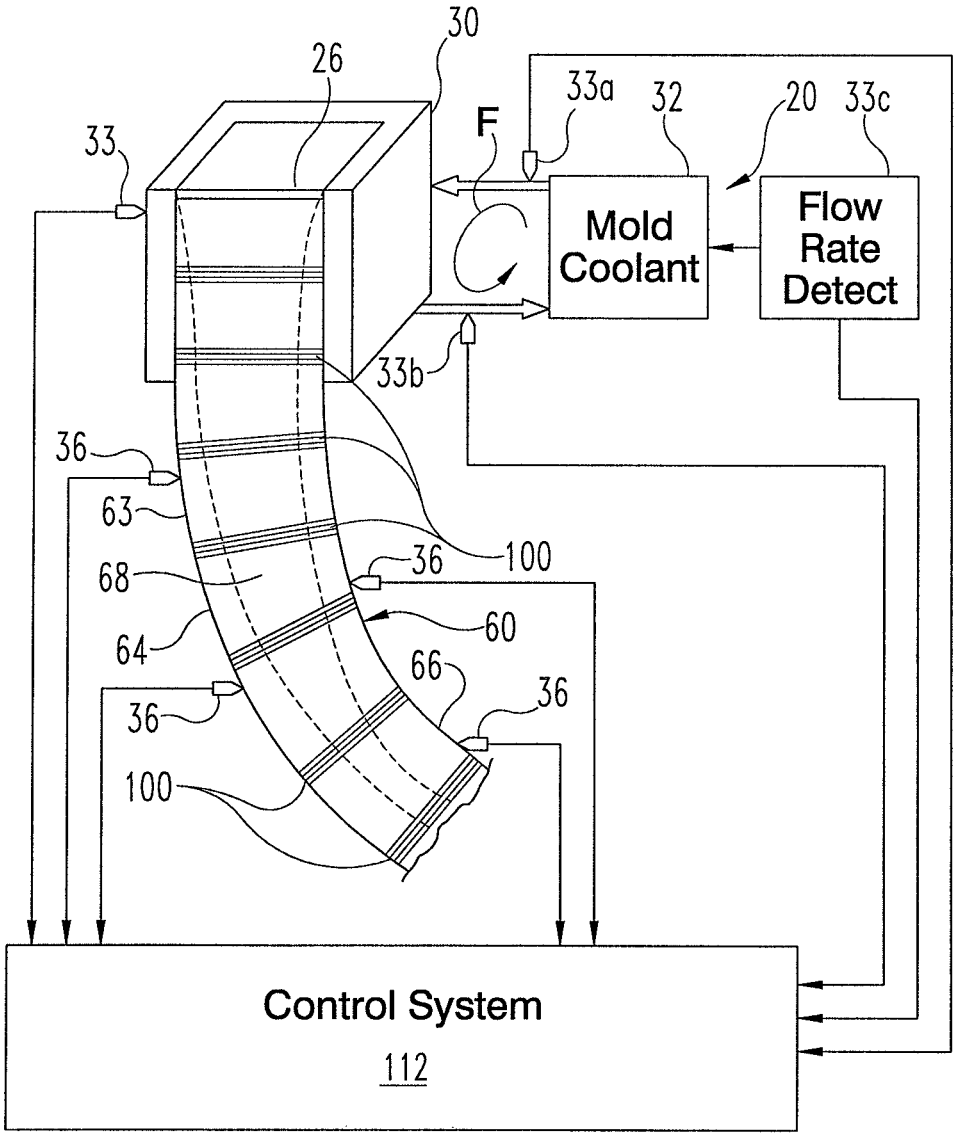
FIG. 2 is a further diagrammatic view of a mold and strand for the caster of FIG. 1 with various temperature sensor inputs to a control system depicted.

Referring additionally to FIG. 2, mold 30 is cooled by a coolant flow F (typically water). The inlet temperature of the coolant is detected with sensor 33*a*, and the outlet temperature of the coolant is detected with sensor 33*b*. The water flow rates are detected with other sensors 33*c*. The pour temperature of molten metal M is detected with sensor 34 (typically measured in an associated tundish). A number of temperature sensors 36 detect temperature of strand 60 along cooling pathway P. Sensors 36 are typically in the form of pyrometers and can be used to calibrate the virtual sensing approach of the present application as further described hereinafter. Temperature signals from sensors 33, 34, and 35 are provided to control system 112, which is further described in connection with FIGS. 3 and 4.

Figure 3:
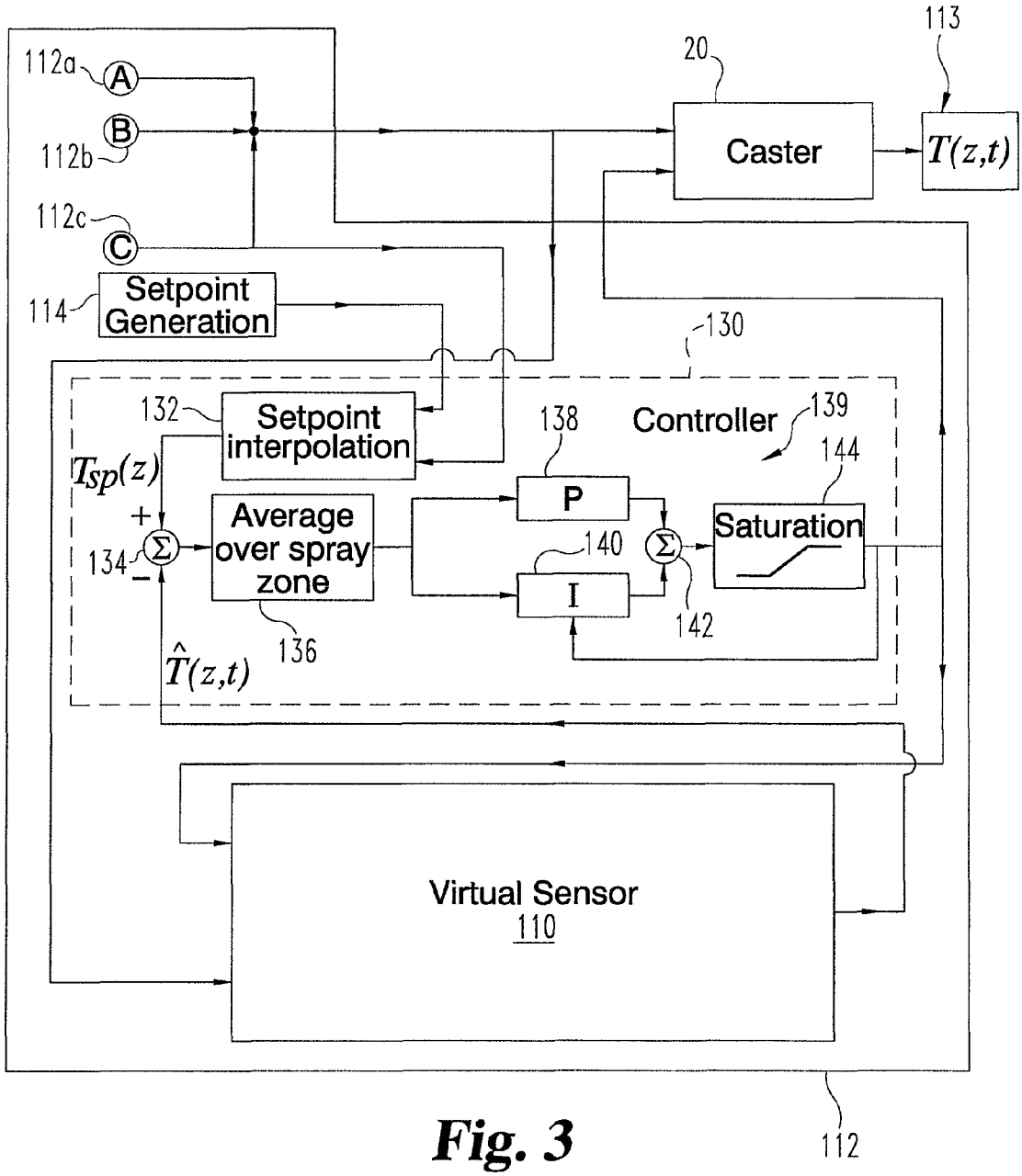
FIG. 3 is a control system diagram for the caster of FIGS. 1 and 2.
Figure 4:
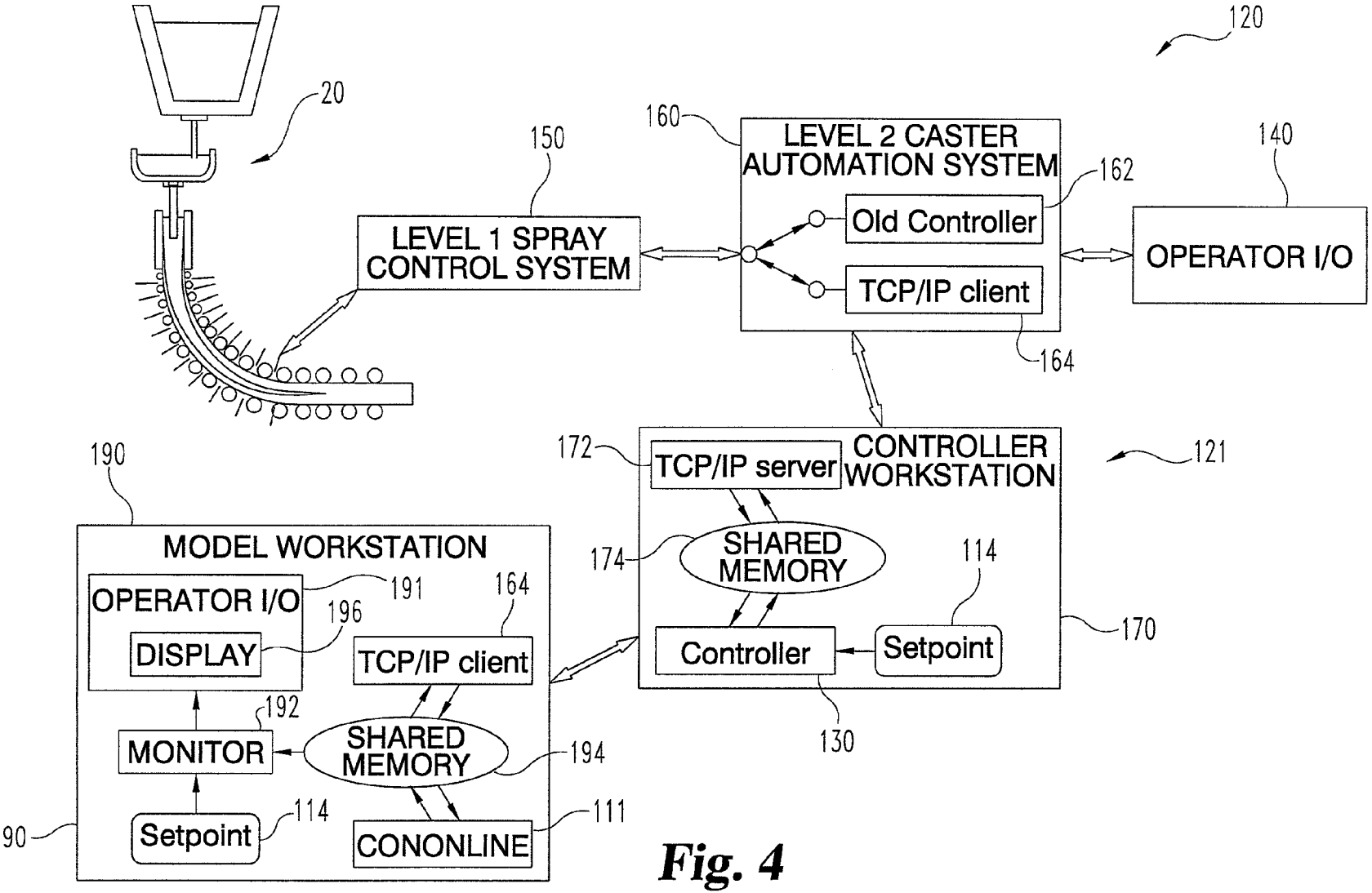
FIG. 4 is a partial diagrammatic view depicting the architecture of one implementation of the control system of FIG. 3.

FIGS. 3 and 4 depict casting control system 112 and system architecture 120 in greater detail, respectively; where like reference numerals refer to like features. Control system 112 is based on a virtual software sensor 110 that detects disturbances relative to a desired cooling profile for strand 60. Sensor 110 is determined with the help of a modified form of the CON1D model, as described subsequently. By way of background, further information about this model is provided in Y. Meng and B. G. Thomas, "Heat-Transfer and Solidification Model of Continuous Slab Casting: CON1D," Metallurgical and Materials Transactions, Vol. 34B (October 2003) (previously incorporated by reference).

Sensor 110 is used to provide a real-time estimate of the strand shell temperature profile based on various casting conditions of caster 20. Generally, casting conditions for caster 20 can be categorized into two groups: (1) conditions updated frequently (in one example about every second), such as mold heat flux (from the cooling water temperatures and flow rates), casting speed, spray cooling rate commands, steel composition, etc; and (2) conditions updated less frequently (in one example only during calibration), such as spray nozzle configuration, mold geometry, calibration strand temperature sensor measurements, and the like. In FIG. 3, these conditions are depicted in different sets A, B, and C; and are further designated as inputs 112*a*, 112*b*, and 112*c* to control system 112 and correspondingly virtual sensor 110. Sets A, B, and C are further described in terms of represented variables in Table I as follows:

TABLE I

| Variable | Input Set (if applicable) | Description |
|---|---|---|
| $k_{steel}$, $\rho_{steel}$, $C^*_{Psteel}$ | B | Thermodynamic variables for steel |
| $Q_{sw}$ | | Spray water volumetric flow rate |
| $Q_{water}$ | | Water flux on spray area |
| A, b, c | | Empirical coefficients |
| $A_{spray}$ (i) | A | Area spray impinges on slab for each zone i |
| $Q_{mw}$ | C | Mold water volumetric flow rate |
| $\Delta T_{mw}$ | C | Mold water temperature change |
| $T_{pour}$ | C | Pour temperature |
| $T_{sp}$ | | Surface temperature setpoint |
| $\hat{T}$ | | Surface temperature estimate |
| e | | Temperature error |
| $l_{shell}$ | | Metallurgical length |
| $n_{roll}$(i) $d_{roll}$(i) | A | Number and size of rolls for each zone i |
| $T_{spray}$ | A | Spray Temperature |
| $V_c$ | C | Caster rate |
| $l_{caster}$, $w_{caster}$, $d_{caster}$ | A | Caster Dimensions |
| $k_p$, $k_i$ | | Controller gains |
| $n_{spray\ pattern}$ | C | Spray pattern |

Control system 112 further includes controller 130 to regulate cooling of strand 60 based on sensor 110. In one implementation, the estimated shell temperature profile $\hat{T}(z,t)$ is recalculated about every second with sensor 110. The estimated shell temperature profile, designated as $\hat{T}(z,t)$ and a predetermined strand surface temperature setpoint profile 114 are input to controller 130. Setpoint profile 114 is processed within controller 130 by a setpoint interpolation operation 132. The interpolated setpoint profile $T_{sp}(z)$ output by operation 132 is input to difference operator 134 along with the estimated profile $\hat{T}(z,t)$ to determine any mismatch, i.e. the tracking 1 control error, which is averaged for each of a number of different cooling zones Z in operation 136. The operating logic of controller 130 defines a number of different feedback control loops, currently employing proportional-integral (PI) control laws 139, however, other control laws can be employed in different embodiments, that are assigned to different cooling zones. Control 139 further includes actuator constraint handling capability, implemented in the form of anti-windup logic as further described hereinafter. The example embodiment depicted has been implemented with 10 control/zone assignments of Table II as follows:

TABLE II

| Zones | Control assigned |
|---|---|
| 1O + 1I | Control 1 |
| 2O + 2I | Control 2 |
| 3O + 3I | Control 3 |
| 4O + 4I | Control 4 |
| 5O | Control 5 |
| 5I | Control 6 |
| 6O | Control 7 |
| 6I | Control 8 |
| 7O | Control 9 |
| 7I | Control 10 |

These zones Z are further illustrated in FIG. 9.

Each control 139 receives the respective averaged error and generates a corresponding cooling device command to adjust one or more corresponding devices 50 in response—driving any mismatch to zero. Accordingly, these commands are sent to caster 20. Also, they are sent to virtual software sensor 110 for estimation/prediction in a subsequent recalculation.

The operation of control system 112 is further described subsequently; however, first the overall architecture 120 of one experimental software/hardware implementation of control system 112 is described in connection with FIG. 4; where like reference numerals refer to like features previously described. Architecture 120 includes caster 20, and a multi-level depiction of caster system control equipment to which control system 112 is applied. This equipment includes spray control system equipment 150 at level 1, and caster automation system 160 at level 2. Also, caster automation system 160 includes an operator interface 140.

Architecture 120 utilizes a number of processing devices 121, including two workstations running the Linux operating system each implemented with dual Intel® Xeon® processors and 2 gigabytes random-access memory. One workstation is referred to as the Model workstation 190 and the other is the controller workstation 170. Communication between them and between the controller workstation 170 and automation system 160 is realized by TCP/IP server 172 and corresponding TCP/IP clients 164, which is another part of the software subsystem. It should be appreciated that processing devices 121 each execute operating logic that is typically in the form of software programming; however, some or all of the operating logic could be defined by firmware and/or hardware. Also, it should be appreciated that in other implementations, different processor types and/or quantities of processors may be used. Alternatively or additionally, a different quantity of memory may be used. The operating logic for devices 121 defines a software subsystem comprising several different programs as listed in Table III that follows:

TABLE III

| Program Name | Reference Numeral | Function | Language |
|---|---|---|---|
| CONONLINE | 111 | estimating/predicting the profile of shell temperature and thickness based on CON1D | Fortran |
| Controller | 131 | computing the required spray water flow rate to maintain temperature setpoint 114 to implement controller 130 | C |
| Monitor | 192 | displaying in real-time shell temperature, thickness profile estimate/prediction, computed water flow rate and casting conditions | |
| TCP/IP server | 172 | working with TCP/IP client programs to transfer data between workstations | |
| TCP/IP client | 164 | working with TCP/IP server program to transfer data between workstations | |

Controller program 131 (Table III) implements controller 130, monitor program 192 displays selected results; and TCP/IP server 172, TCP/IP client 164 provide for communications. All were written in C. CONONLINE program 111 was written in FORTRAN, which was the same language used to initially define the CON1D model in software. Other computing languages could be substituted. Monitor program 192 also runs on the Model workstation 190, using the graphing capability provided by GTK+ and GDK for LINUX. The controller program 131 runs on the Slackware Linux operating system to ensure real-time output of the spray rate commands.

Workstation 190 is further depicted with operator Input/Output (I/O) equipment 191 that specifically includes display 196 responsive to monitor program 192. Display 196 can be of any type, such as a plasma, Cathode Ray Tube (CRT), or Liquid Crystal Display (LCD) type. Equipment 191 may further include one or more other operator output devices, such as a printer, an aural output system and/or different output device type as would occur to those skilled in the art. Equipment 191 also includes one or more input devices (not shown), such as a conventional mouse and keyboard, a trackball, light pen, voice recognition subsystem, touch screen matrix, and/or different input device type as would occur to those skilled in the art. Workstation 170 may include operator equipment, too (not shown).

Architecture 120 has two main modes of operation: (1) shadow mode and (2) implementation mode. Selection between these two modes is logically depicted by a 2-way selection switch in the level 2 caster automation system 160. In shadow mode, the switch allows one-way transfer of data from caster 20 to TCP/IP client 164 in the level 2 system, while monitoring the spray rate commands generated by a standard controller 162. Shadow mode facilitates gathering of comparative data, and testing/tuning of control system 112 offline, but still using real caster data. In the implementation mode, controller 162 is disconnected, and controller 112 is connected to provide spray rate control via client 164/server 172.

At each second, the level 2 system 150 collects casting conditions such as casting speed and mold heat flux (from sensors 33-35), and sends the corresponding data via client 164 of system 150 to controller workstation 170. The casting conditions are received by server 172 in controller workstation 170 and then the client 164 in model workstation 190. This information is provided to the other programs running on both workstations 170 and 190 via the workstation's shared memories 174 and 194, respectively. For one experimental implementation, the TCP/IP client 164 and server 172 are designed to exchange data in each shared memory 174 and 194 approximately 10 times per minute and each transmission takes less than 20 milliseconds (ms). This transmission rate is an order of magnitude higher than the sampling rate of system 112, which is about 1 second, and provides sufficiently fast data sharing between different control system components.

The software sensor 110 defined by CONONLINE program 111 obtains casting conditions once every second from shared memory 194 and then estimates/predicts strand shell temperature profile $\hat{T}(z,t)$, which is made available to controller 130 as defined by controller program 131 that is executed with controller workstation 170 via shared memory and TCP/IP transmission. Controller program 131 reads the predicted shell temperature profile $\hat{T}(z,t)$ from shared memory 174 on controller workstation 170 and computes the spray water flow rate zones Z commands to maintain this profile at the temperature profile setpoint 114. The computed spray water flow rate control command is first saved to shared memory 174 on controller workstation 170, and then is transmitted to caster 20 for real-time cooling control. The command is also transmitted to model workstation 190 for CONONLINE program 111 to recalculate the predicted shell temperature profile $\hat{T}(z,t)$ at the next time step, and to update monitor program 192 for presentation on display 196.

Figure 12:
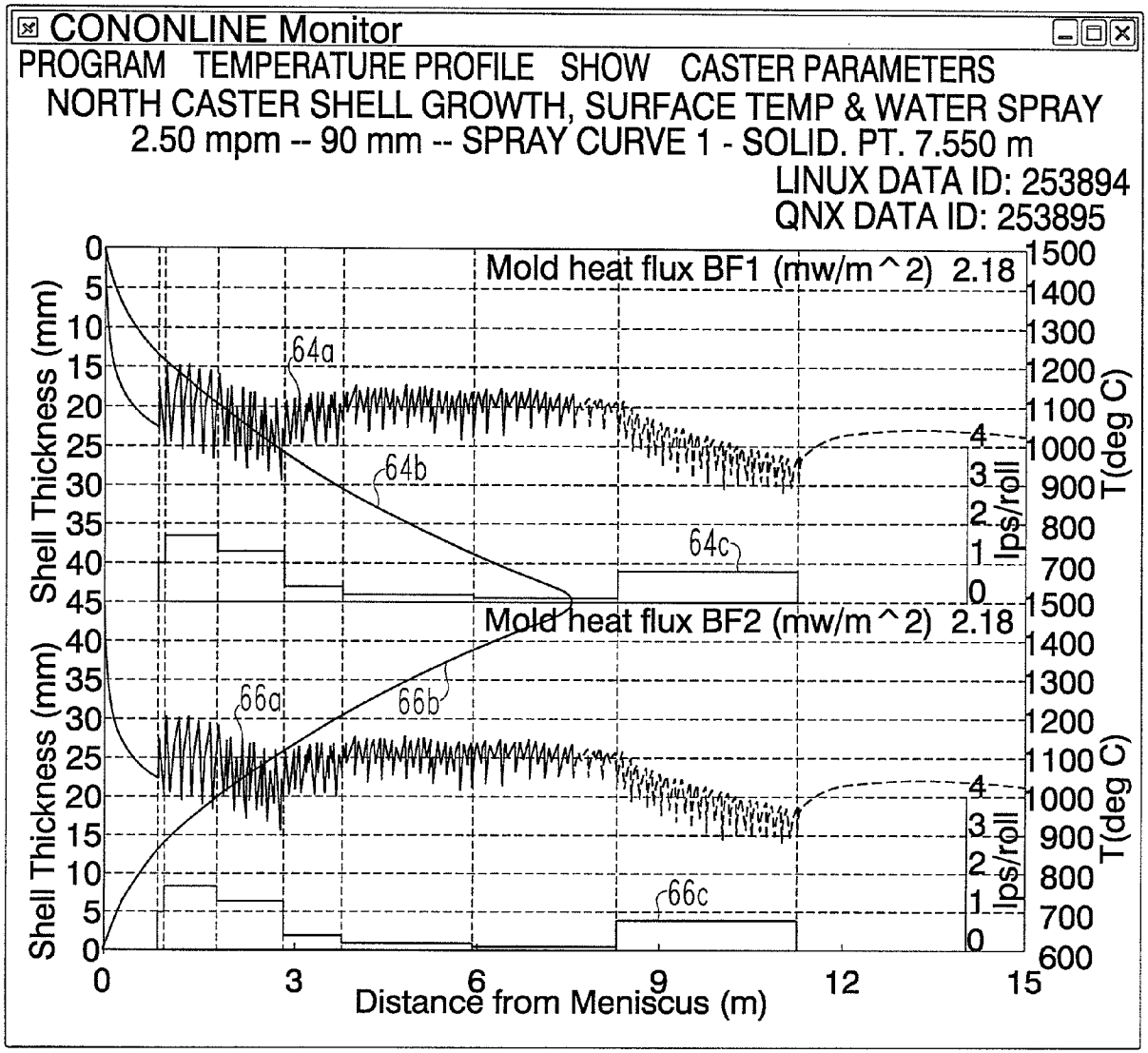
FIG. 12 is a computer generated display view for a graphical user interface that depicts the following for both the outer and inner radii sides of the strand: the shell thickness profile for each side, the metallurgical length of the strand, the shell surface temperature profile estimation/prediction, its corresponding setpoints (targets), the spray-water flow rate commands and their setpoints, and other operator information.

FIG. 12 presents a sample visualization of control system results generated by monitor program 192 that may be presented with display 196. Monitor program 192 provides real-time access to a variety of variables, estimation/prediction results, and commands, permitting operators and plant metallurgists to monitor control system performance. The variables include the shell temperature profile plots 64*a* and 66*a* for each side 64 and 66 of strand 60, respectively; corresponding shell thickness prediction plots 64*b* and 66*b*, plots of the relative level of water flow rate control commands 64*c* and 66*c* having a bar-graph like appearance, and various casting conditions. To better present metallurgical length, the color of temperature profile plots 64*a* and 66*a* change color where the thickness prediction plots 64*b* and 66*b* come together. Accordingly, monitor program 192 provides feedback to operators and engineers by displaying a variety of information graphically. This information can be useful for monitoring of the control system performance, monitoring of the temperature profile, to ensure that quality limits are maintained, monitoring of the shell evolution and the metallurgical length, to ensure that the machine support length is never exceeded, and comparing the old and the new controller commands for better understanding of spray cooling. It should be appreciated that both workstations 170 and 190 include the shell surface temperature setpoint profile 114 to provide for use/display by both the monitor program 192 and the controller program 131.

Next, further aspects of control system 112 are described as implemented with controller program 131—including virtual sensor 110 as defined by CONONLINE program 111. CONONLINE program 111 is based on the CON1D model, which models heat transfer and solidification of the continuous casting of steel slabs, including phenomena in both the mold and the spray regions. Accuracy of the CON1D model in predicting heat transfer and solidification has been demonstrated through comparison with analytical solutions and plant measurements.

The simulation domain of the CON1D model is a transverse slice 100 through the thickness of the strand 60 that spans from the center of shell surface of the inner radius Ito that of the outer radius O. A few representative slices 100 are schematically designated by reference numeral in FIGS. 2 and 9. The CON1D model computes the temperature and solidification history of each slice 100 as it travels along pathway P from meniscus 26 at the top of mold 30 down through the spray zones Z to the end of caster 20. CON1D solves the 1-D transient heat conduction equation within the solidifying steel shell as set forth in expression (1) that follows:

$$\rho_{steel} Cp^*_{steel} \frac{\partial T}{\partial t} = k_{steel} \frac{\partial^2 T}{\partial x^2} + \frac{\partial k_{steel}}{\partial T}\left(\frac{\partial T}{\partial x}\right)^2 \tag{1}$$

Figure 5:
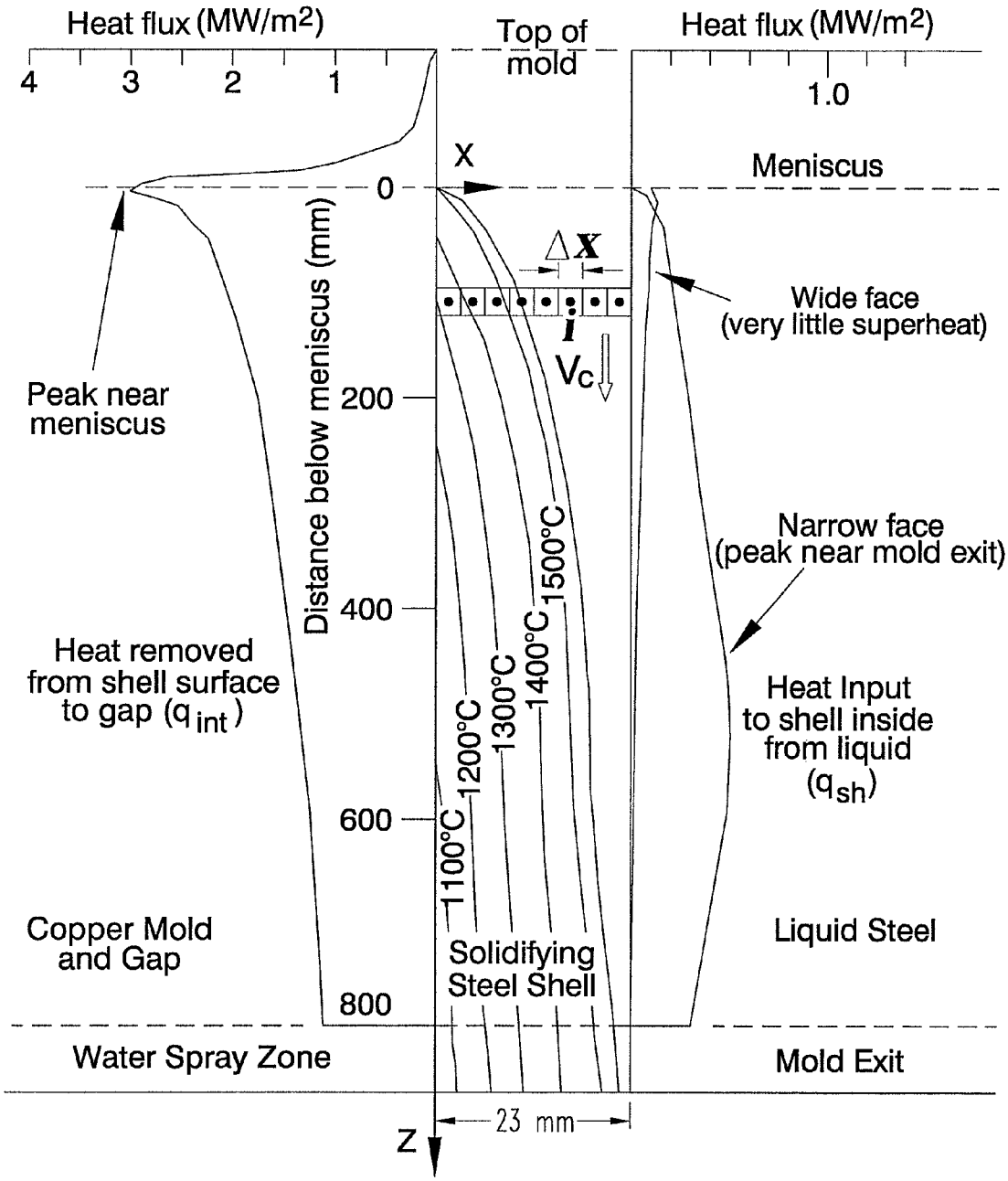
FIG. 5 is a diagram illustrating various aspects of heat transfer in the mold region.

This model predicts shell thickness, temperature distributions in the mold and shell, total heat removal, heat flux profiles down the mold face, mold water temperature rise, ideal taper of the mold walls, and other phenomena. The calculation takes advantage of the high Peclet number of the process, which renders axial heat conduction negligible. The effect of non-uniform distribution of superheat is incorporated using the results from previous 3-D turbulent fluid flow calculations within the liquid pool. The two heat flux profiles from superheat and surface extraction are shown in the model domain with a typical temperature profile along the strand in the mold region like that shown in FIG. 5.

Below mold 30, heat flux from the strand surface can vary greatly between each pair of rolls 40 according to spray nozzle cooling (based on water flux), $h_{spray}$, radiation, $h_{rad_spray}$, natural convection, $h_{conv}$, and heat conduction to rolls 40, $h_{roll}$, as shown on the right-hand site of FIG. 8 in relation to a corresponding spray nozzle 46 and pair of rolls 40 as comparatively shown on the left-hand side of FIG. 8. Incorporating these phenomena enables the CON1D model to simulate heat transfer during the entire continuous casting process.

The CON1D model finds the boundary heat flux between mold 30 and strand 60 (see $q_{int}$ in FIG. 5) by solving a two dimensional heat equation for mold 30. However, because this can be computationally intensive, an alternative approach for control system 112 models the boundary heat flux within mold 30 with an empirically-based heat flux curve that is fitted to match the total mold heat removal, $Q_{mw}$, typically measured from the temperature change and flow rate of the coolant flow F. This curve is defined as a function of the time spent in mold 30, and is split into a linear portion and an exponential portion as set forth in the following expression (2):

$$q_{mold} = \begin{cases} q_0 - q_a \cdot t, & 0 \le t < t_c \\ q_b \cdot t^{-n}, & t_c < t \le t_m \end{cases} \tag{2}$$

where n is a tuning parameter for determining the shape of the curve. The initial heat flux, $q_o$, is the maximum heat flux at meniscus 26, given by expression (3) as follows:

$$q_0 = Q_{mw} \cdot q_{fac} \tag{3}$$

where $q_{fac}$, is another parameter. The total time spent in mold 30, $t_m$, is calculated according to expression (4) as follows:

$$t_m = \frac{z_m}{V_c} \tag{4}$$

where $z_m$ is the mold length and $V_c$ is the casting speed. The length of the linear portion, $t_c$, is defined by expression (5) as follows:

$$t_c = t_m \cdot t_{fac} \tag{5}$$

where $t_{fac}$ is another tuning parameter. Intermediate parameters $q_a$ and $q_b$ are defined by expressions (6) and (7) as follows, based on keeping the curve continuous, and matching the total mold heat flux in mold 30 with the area underneath the curve:

$$q_a = \frac{q_0 \cdot (t_c)^n (t_m)^{1-n} - (1-n) \cdot Q_{mw} \cdot t_m - n \cdot q_0 \cdot t_c}{t_c^{1+n} \cdot t_m^{1-n} - \frac{1}{2}(1+n)t_c^2} \quad (6)$$

$$q_b = q_0 \cdot (t_c)^n - q_a (t_c)^{n+1} \quad (7)$$

This model compares favorably the two-dimensional result from the CON1D model, the accuracy of which has been verified against a more complete finite element analysis and plant measurements. Nonetheless, alternative equations to relate the measured mold heat flux $Q_{mw}$, to the heat flux profile down the mold, $q_{mold}$, can be used instead.

Below mold 30, heat flux from the surface of strand 60 can vary greatly with thermal impact of support rolls 40 and cooling from spray nozzles 46. This cooling (based on water flux), $h_{spray}$; radiation, $h_{rad_spray}$; natural convection, $h_{conv}$; and heat conduction to the rolls, $h_{roll}$; are depicted on the left-hand side of FIG. 8 relative to the representative nozzle 46 and adjacent rolls 40 depicted on the right-hand side of FIG. 8. Incorporating these phenomena enables the model to simulate heat transfer during the entire continuous casting process. The heat extraction due to water sprays is a function of water flow according to equation (8) as follows:

$$h_{spray} = A \cdot Q_{water}^{c} \cdot (1 - b \cdot T_{spray}) \quad (8)$$

where $Q_{water}$ (L/m$^2$s, where L stands for liters) is water flux in the spray zones and $T_{spray}$ is the temperature of the spray cooling water. From Nozaki's empirical correlation, A=0.3925, c=0.55, b=0.0075. This correlation is further described in T. Nozaki, "A Secondary Cooling Pattern for Preventing Surface Cracks of Continuous Casting Slab," *Trans. ISIJ*, Vol. 18, 1978, 330-338, which is hereby incorporated by reference in its entirety. Relationships describing the variation of heat flux with nozzle type, nozzle-to-nozzle spacing, spray water flow rate, heat transfer for spray cooling, and distance of the spray nozzles from the strand surface are available and can be used to account for changes with respect to spray nozzle cooling. Further information can be found in J. K. Brimacombe, P. K. Agarwal, S. Hibbins, B. Prabhaker, L. A. Baptista, "Spray Cooling in Continuous Casting," in *Continuous Casting*, Vol. 2, J. K. Brimacombe, ed. Iron and Steel Society, Warrendale, Pa., 1984, 105-123; E. Mizikar, *Iron Steel Engineer*, Vol. 47, 1970, 53-60; L. K. Chiang, in *57th Electric Furnace Conference*, Iron & Steel Society, Warrendale, USA, (Pittsburgh, USA), 1999; K. Tanner, "Comparison of Impact, Velocity, Dropsize, and Heat Flux to Redefine Nozzle Performance in the Caster," in *MS&T Conference Proceedings*, B. G. Thomas, ed. Association for Iron and Steel Technology, Warrendale, Pa., (New Orleans, Sep. 24-28, 2004), 2004; and K. Kasperski, "Spray Cooling Results of Air/Mist Spray Nozzles with Reduced Air Volumes," in *MS&T Conference Proceedings*, B. G. Thomas, ed. Association for Iron and Steel Technology, Warrendale, Pa., (New Orleans, Sep. 24-28, 2004), 2004; all of which are hereby incorporated by reference each in its entirety. Furthermore, controlled laboratory experiments can be performed to obtain fundamental values of $h_{spray}$ for nozzle geometries and conditions which are not readily available.

To avoid cracks, it is often necessary to keep strand 60 above a critical temperature, such as the AR3 temperature for steel (~700° C.).

Radiation, $h_{rad_spray}$ W/m$^2$K) is defined by expression (9) as follows:

$$h_{rad_spary} = \sigma \cdot \epsilon_{steel} (T_{sK} + T_{ambK})(T_{sK}^2 + T_{sprayK}^2) \quad (9)$$

where $T_{sK}$ and $T_{sprayK}$ are $T_s$ and $T_{spray}$, respectively; and are expressed in Kelvin. Natural convection is treated as a constant input for every spray zone Z, which typically varies little for water-cooling. It has been set to 8.7 W/m$^2$K. Larger value(s) can be used for $h_{conv}$ to reflect stronger convection typically of air mist application in the cooling zone. Heat extraction into rolls 40 is calculated based on the fraction of heat extraction, $f_{roll}$, which is calibrated for each spray zone Z:

$$h_{roll} = \frac{(h_{rad_spray} + h_{conv} + h_{spray}) \cdot L_{spray} + (h_{rad_spray} + h_{conv}) \cdot (L_{spray\ pitch} - L_{spray} - L_{roll\ contact})}{L_{roll\ contact} \cdot (1 - f_{roll})} \cdot f_{roll} \quad (10)$$

A typical $f_{roll}$ value of 0.05 produces local temperature drops beneath rolls 40 of about 100° C. Beyond the spray zones Z, heat transfer simplifies to radiation and natural convection.

The CON1D model has been calibrated offline to match experimental measurements on several different operating slab casters. With respect to caster 20, the calibration process includes comparison to temperatures along pathway P detected with sensors 36 (FIG. 2). While pyrometer-type sensors 36 and the like can be used in lieu of virtual sensing, they are typically unreliable. Furthermore actual sensing cannot practically provide the number of temperature measurements along pathway P that can be provided as estimates with virtual sensor 110.

Figure 7:
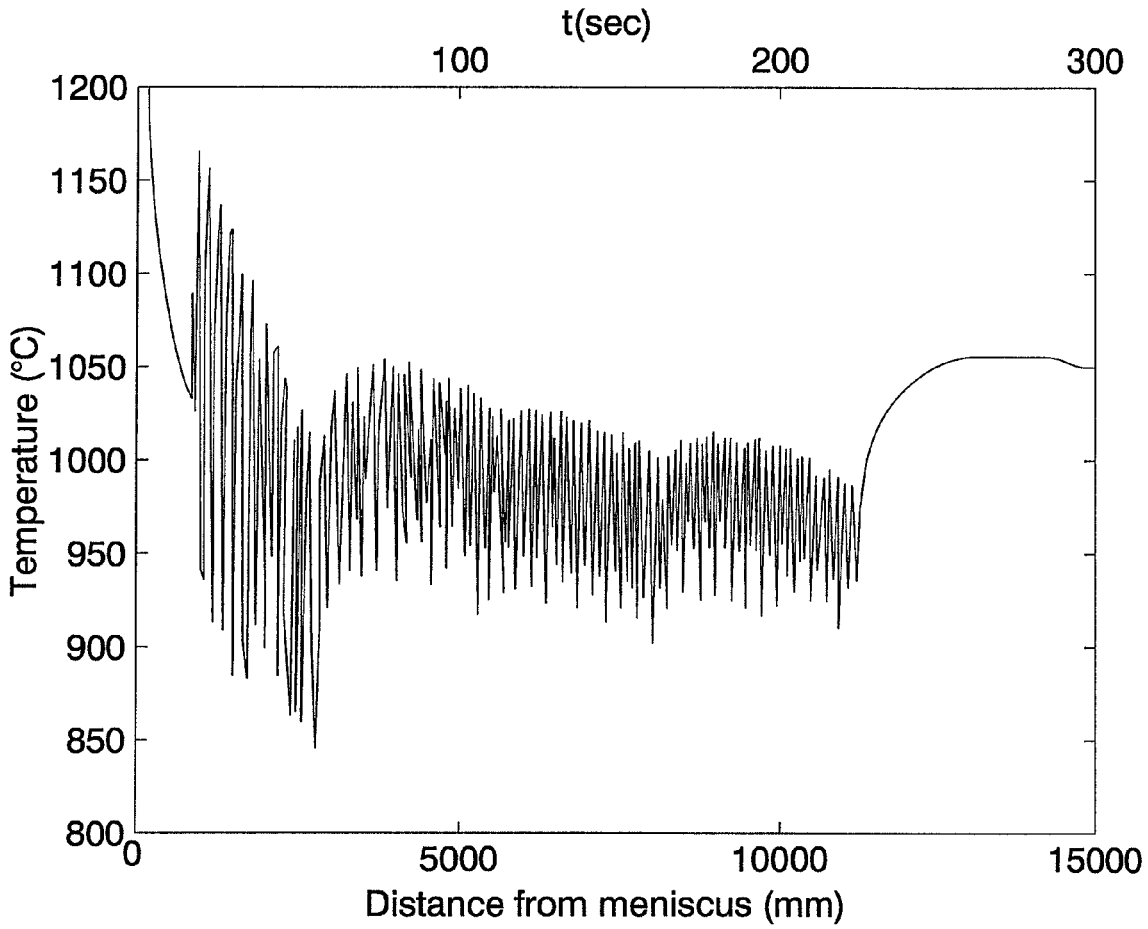
FIG. 7 is a graph of surface temperature along one side of a strand produced with the caster of FIG. 1 relative to strand distance from the meniscus at the top of the caster mold.

An example of the predicted surface temperature history of a slice generated with the CONONLINE program 111 relative to distance z from meniscus 26 is plotted in FIG. 7. It should be appreciated that there are a number of temperature peaks and dips corresponding to the thermal transfer characteristics of rolls 40 and application of spray nozzles 46. The temperature dips are caused by water spray impingement and roll contact, and the temperature peaks occur where convection and radiation are the only mechanisms of heat extraction.

The CONONLINE program 111 manages the temperature profile histories of N different slices 100, each starting at meniscus 26 at a different time to achieve a fixed z-distance spacing between slices 100 along caster 20. The software executing the CON1D model is a subroutine of the CONONLINE program 111 that simulates temperature over a specified time (length) interval, given a previously-calculated and stored temperature distribution across the thickness of slice 100 at the start of the interval. Based on the CON1D model, the CONONLINE program 111 provides the temperature for each zone in accordance with expression (11) as follows, which is a form of the central finite-difference method:

$$T_i^{new} = T_i + \frac{\Delta t \cdot k_{steel}}{\Delta x^2 \cdot \rho_{steel} \cdot C_{Psteel}^*}(T_{i-1} - 2T_i + T_{i+1}) + \frac{\Delta t}{4\Delta x^2 \cdot \rho_{steel} \cdot C_{Psteel}^*} \frac{\partial k_{steel}}{\partial T}(T_{i+1} - T_{i-1})^2 \quad (11)$$

The efficiency of the methodology used in the CONONLINE program enables the use of a fine mesh (small value of $\Delta x$) and small time step ($\Delta t$), which enables a high accuracy of the solution using Eq. 11.

Boundary conditions for expression (11) are defined by expressions (12)-(15) as follows:

$$T_{surf}^{new} = T_i^{new} = T_1 + \frac{2\cdot\Delta t\cdot k_{steel}}{\Delta x^2\cdot\rho_{steel}\cdot C_{Psteel}^*}(T_2 - T_1) + \frac{\Delta t}{\Delta x^2\cdot\rho_{steel}\cdot C_{Psteel}^*}\frac{\partial k_{steel}}{\partial T}\left(\frac{q}{k_{steel}}\right)^2 - \frac{2\Delta t\cdot q}{\Delta x\cdot\rho_{steel}\cdot C_{Psteel}^*} \tag{12}$$

$$q = \begin{cases} q_{mold}, & z < z_{mold} \\ q_{sprays}, & z > z_{mold} \end{cases} \tag{13}$$

$$q_{sprays} = A\left(\frac{Q_{sw}}{A_{spray}}\right)^c(1 - bT_{spray})(T - T_{spray}) \tag{14}$$

$$\int_{moldzone} q_{mold} = p_{water}c_{Pwater}Q_{mw}\Delta T_{mw} \tag{15}$$

The initial condition imposed is defined by expression (16) as follows:

$$T|_{z=0} = T_{pour} \tag{16}$$

As applied, CONONLINE program 111 provides temperature values to compose the strand shell surface temperature profile along the entire casting length for each side 64 and 66 of strand 60. The actual profile is designated T(x,z,t); where x is distance from the surface, z is the distance along caster 20 from meniscus 26, and t is time. T(0,z,t) is used to compute average surface temperatures of each spray zone, providing the previously introduced profile estimate $\hat{T}(z,t)$. When plotted on a two-dimensional t-z grid, the desired output domain of software sensor 110 is a horizontal line, as shown in the upper graph of FIG. 10. For instance, at time $t_0$ the sensor predicts $T(z,t_0)$ for $0 \le z \le z_c$, where $z_c$ is the caster length. If the casting speed is a constant, the surface temperature history included in the temperature history of the slice output from the CON1D model is a straight line in the upper graph of FIG. 10 having an angle $\theta$ with the t axis. It also follows that $\tan(\theta)$ equals the casting speed, such that $\theta$ is always between 0 and 90 degrees. If the casting speed varies with time, then the CON1D output domain is not a straight line, but a curve in general.

Each complete run of the CON1D model contributes one data point to the output of sensor 110, namely, $T(z_0,t_0)$. Thus, the results from many CON1D model runs each starting at a different time are interpolated in order to achieve a single software sensor output. FIG. 2 shows the revised simulation domain, with multiple slices 100 spaced equally throughout caster 20. Data points in the temperature profile estimation/prediction $\hat{T}(z,t)$ that come directly from the CON1D model output without any interpolation/approximation, such as $T(z_0,t_0)$, are termed "exact" estimations/predictions. Because a CON1D run takes about 0.6 seconds on workstation 190, obtaining N data points in the shell temperature profile by having N complete runs of the CON1D model requires 0.6N seconds. With such processing time limitations, the CONONLINE program 111 runs the CON1D model for an incremental time period for each slice 100 and the shell surface temperature profile is approximated by interpolating between the latest temperature histories available from each such slice 100, described as follows.

The CONONLINE program 111 maintains the temperature profile histories of N different slices 100, each starting at a different time with fixed z-distance between slices 100. Within the CONONLINE program 111, the CON1D model software simulates temperature over a specified time (length) interval, given a previously-calculated and stored temperature distribution across the thickness of slice 100 at the start of the interval. Exploiting this feature, exact temperature estimation/prediction can be obtained from N incremental CON1D model simulations, while requiring about the same computational time as just one CON1D simulation of the entire caster length.

Figure 10:
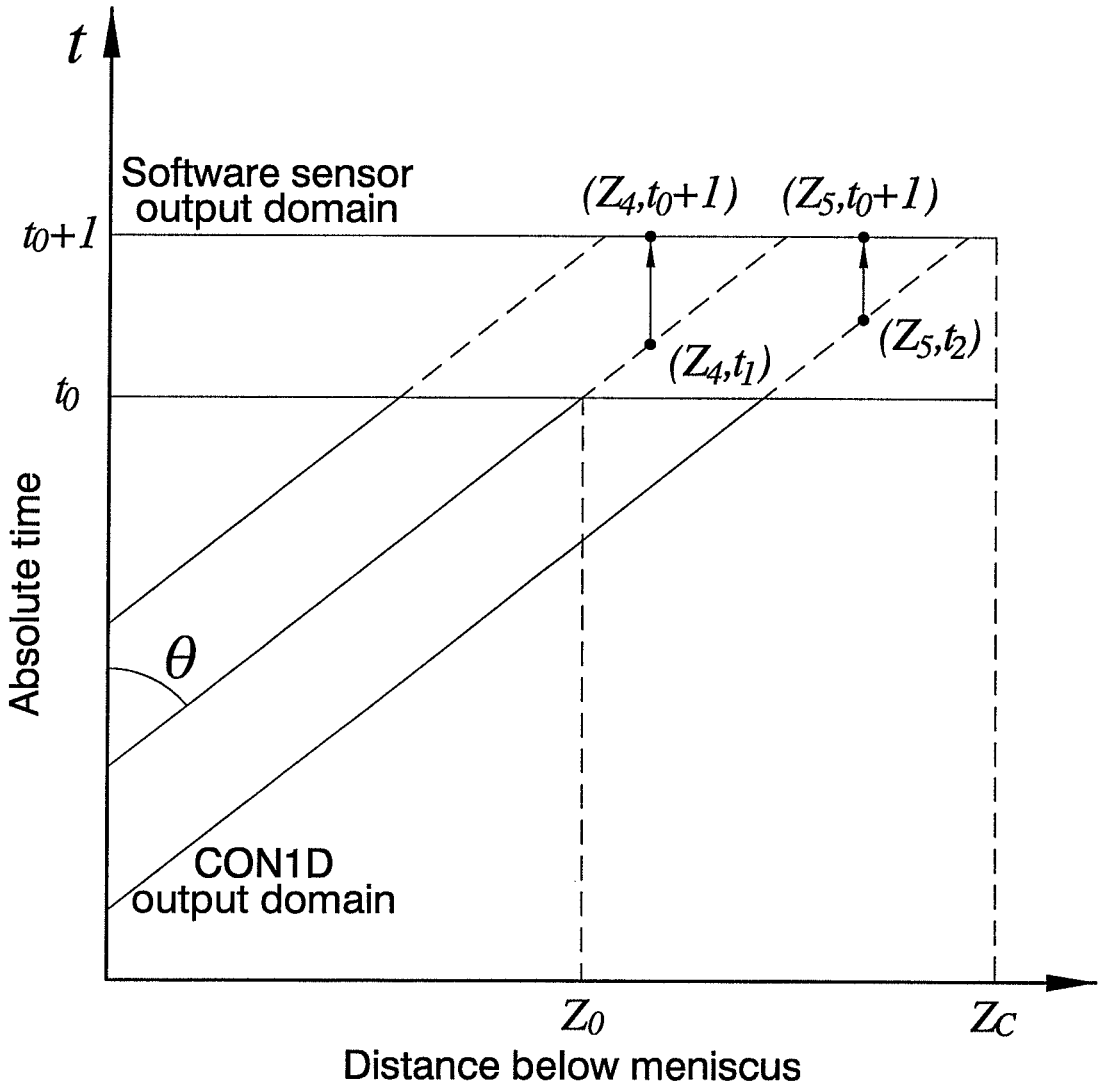
FIG. 10 depicts two comparative graphs illustrating various aspects of temperature profile estimation with the virtual sensor of the control system of FIG. 3.

By way of example, this approach is illustrated in the lower graph of FIG. 10 for N=3 slices 100. To preserve clarity, this example uses relatively few slices 100 compared to an experimental implementation that used N=200 slices 100. At time $t_0$, a temperature profile prediction $\hat{T}(z,t)$ is obtained from the simulation results of the N=3 slices 100 being tracked as follows. Exact predictions are known at N locations from previous calculations, including N complete restarting temperature distributions. As shown in the lower graph of FIG. 10, for N=3, the simulation is restarted for each of the 3 slices and computed for 1 second of casting time, such that exact shell surface temperature predictions result at 3 locations at the next second $t_0+1$, giving: $T(z_1,t_0+1)$, $T(z_2,t_0+1)$, and $T(z_3,t_0+1)$. For a current casting speed of 3 m/minute (50 mm/s), the simulation produces temperature histories for an additional 50 mm. This efficient method of running N incremental slices allows sensor 110 to achieve N exact shell surface temperature predictions. For a caster of 15 m length, a maximum of 15000/50=300 slices can be tracked with a total computation time of 0.6 second per second of casting time. In consideration of sparing more time for other programs and securely finishing the prediction within one second, the number of slices 100 selected for experiments was N=200, which yields an approximate computation time of 0.4 seconds for software sensor 110.

The management of the slice data for this N=200 example is next further described. For the 15 m caster 20 used experimentally, the inter-slice distance is 15000/200=75 mm. Slices 100 to be simulated form a queue along the casting direction of pathway P, as shown in FIG. 9, where the first slice 100 is the one entering the queue first, i.e. the one closest to the end of caster 20, and the last slice is the one entering the queue last, i.e. the one closest to meniscus 26. At caster startup, one slice 100 is added to the queue and simulated, or "cast," by the CON1D model software, which becomes the initial slice 100. At the time when this slice is 75 mm from meniscus 26, another slice 100 is then added to the queue. Likewise, still another slice 100 is added to the queue when the second slice is 75 mm from meniscus 26. This procedure is repeated until the startup is complete, i.e. the initial slice reaches the end of caster 20. At this time, the first slice 100 is removed from the queue, and a new slice 100 is added to the queue such that the total number of slices 100 is always 200 after startup is complete. Note that all slices 100 are "cast" using the CON1D model software with the same casting speed and 200 slices are evenly distributed along the total caster length of 15 m.

With 200 slices, exact shell surface temperature estimates/predictions are obtained each second for 200 locations. The remaining problem is how to obtain temperature estimates/predictions for the locations in between. Linear interpolation would be very inaccurate because it neglects most of the temperature peaks and dips caused by spray impingement, roll contact, and convection, etc, causing errors as large as 100 degrees at some locations.

Figure 11:
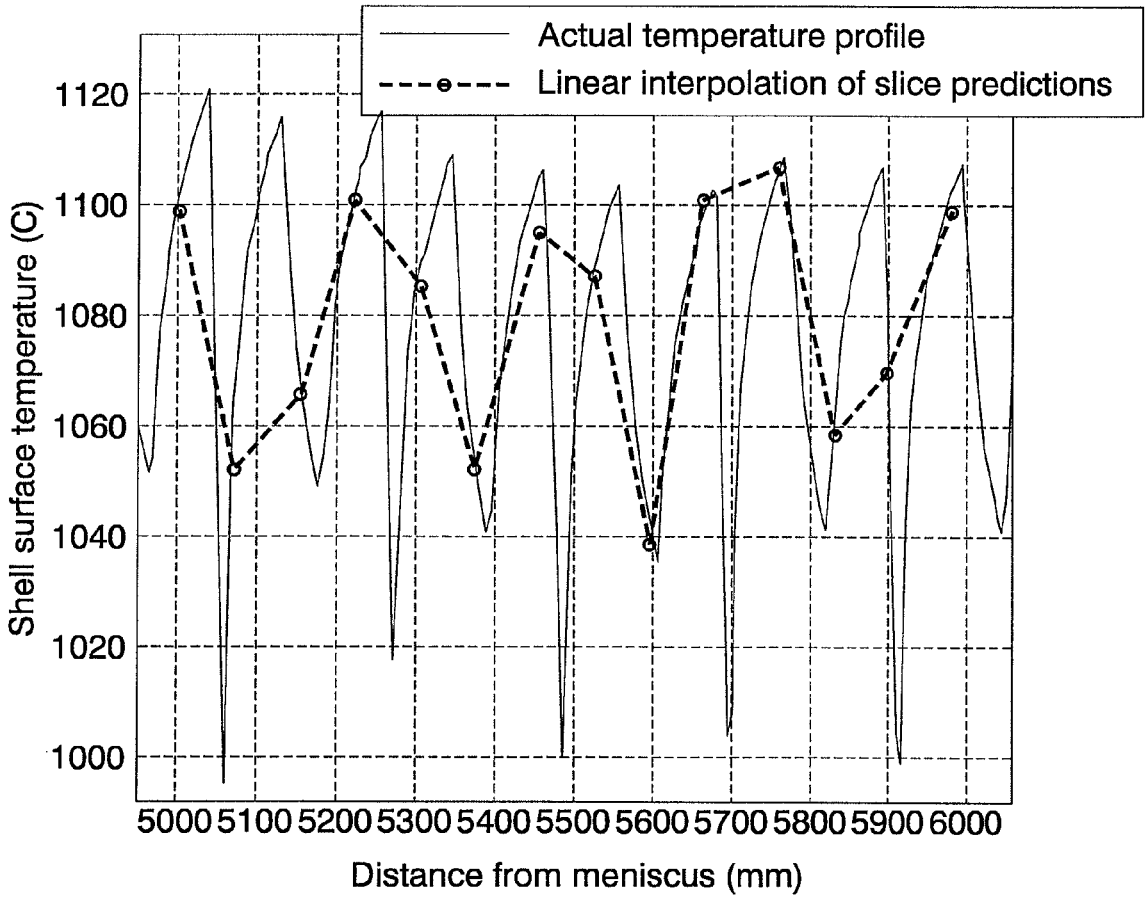
FIG. 11 depicts a graph illustrating one interpolation technique for the temperature profile estimation with the virtual sensor.

A more accurate determination of points in between exact CON1D predictions is to approximate the temperature prediction at those points at the current time with the latest historical temperature estimates/predictions previously obtained for those locations from the temperature history of CON1D slices, which is illustrated in FIG. 11; where it can be seen that the temperatures $T(z_4,t_1)$ and $T(z_5,t_2)$ are used to approximate $T(z_4,t_0+1)$ and $T(z_5,t_0+1)$, respectively. The same approximation method applies to any other locations where exact, incremental predictions are not available. Based on this approach, a control-oriented shell surface temperature profile T(z,t) is obtained at any time t, given by expression (17) as follows:

$$T(z,t)=T_{1D}^{i}(z),\ \text{if}\ z_{i+1}(t)<z_i\leq(t) \tag{17}$$

where: $z_i(t)$, i=1, 2, . . . , N=200 denotes the location of the $i^{th}$ slice 100 at time t, and $T_{1D}^{i}(z)$ is its temperature history from the CON1D model.

It can be seen that the approximation error introduced at location $z_4$ is the temperature change at this location from time $t_1$ to $t_0+1$, which is a function of slice spacing. It follows that slices 10 should be evenly distributed to minimize the approximation error. The average error can be estimated by the temperature change at a given location in half of the time it takes for slice 100 to travel the distance of slice spacing. When 200 slices are evenly distributed for a 15 m caster casting at 3 m/min, it takes a slice 1.5 seconds to travel the slice spacing of 75 mm. Thus, the average approximation error is the temperature change in 1.5/2=0.75 seconds, which is usually less than ~30 degrees in transient and decays toward zero as the temperature approaches steady state.

Next, the operating logic of spray controller 131 is further described. Because inter-slice heat transfer is negligible, the controller program 131 defines decentralized Single-Input-Single-Output (SISO) controllers (which have no inter-controller interaction) to control the spray-water flow rates by reducing the error between the CONONLINE program 111 prediction and the setpoint temperature profile 114 input (See FIG. 3). One or more Multi-Input-Multi-Output (MIMO) controllers are an alternative, but can be more complicated to design and implement in at least some applications.

The temperature control problem in a given spray zone Z can be regarded as a disturbance rejection problem, in which the heat flux from liquid core 68 at the liquid/solid interface inside strand 60 can be treated approximately as a constant disturbance and the control goal is to maintain shell surface temperature under this disturbance. An appropriate Proportional-Integral (PI) control law has been selected to address this goal. The integral part of the PI control is desired to maintain surface temperature with no steady-state error under a constant setpoint while rejecting the constant disturbance. Derivative control, which is normally introduced to increase damping and stability margin, is not necessary under typical circumstances because the system itself is well-damped; however it should be appreciated that other control laws could be utilized in other embodiments as needed to address the specifics of the system.

As previously described in connection with FIG. 9, cooling fluid discharge devices 50 are grouped into seven inner and seven outer spray zones Z according to location and control authority; where nO and nI denote the nth outer and inner zones Z, respectively. Furthermore, for our experimental example, zones 1O and 1I together can be given only one spray rate command, so all the spray nozzles in zones 1O and 1I share the same spray rate. This single command for inner and outer zones is also the case for subsequent spray zones up through zones 4O and 4I. The remaining 6 zones each have a separate command for the inner and outer zones, such that a total of 4+6=10 independent PI controllers are utilized. The controller assignment for each zone is listed in Table II. The parameters of each controller are tuned separately to meet the control performance in each zone/zone pair. Further subdivision of the spray flow rates across strand 60 is prescribed from these 10 control signals according to slab width, and can vary with casting speed changes and other disturbances.

Figure 6:
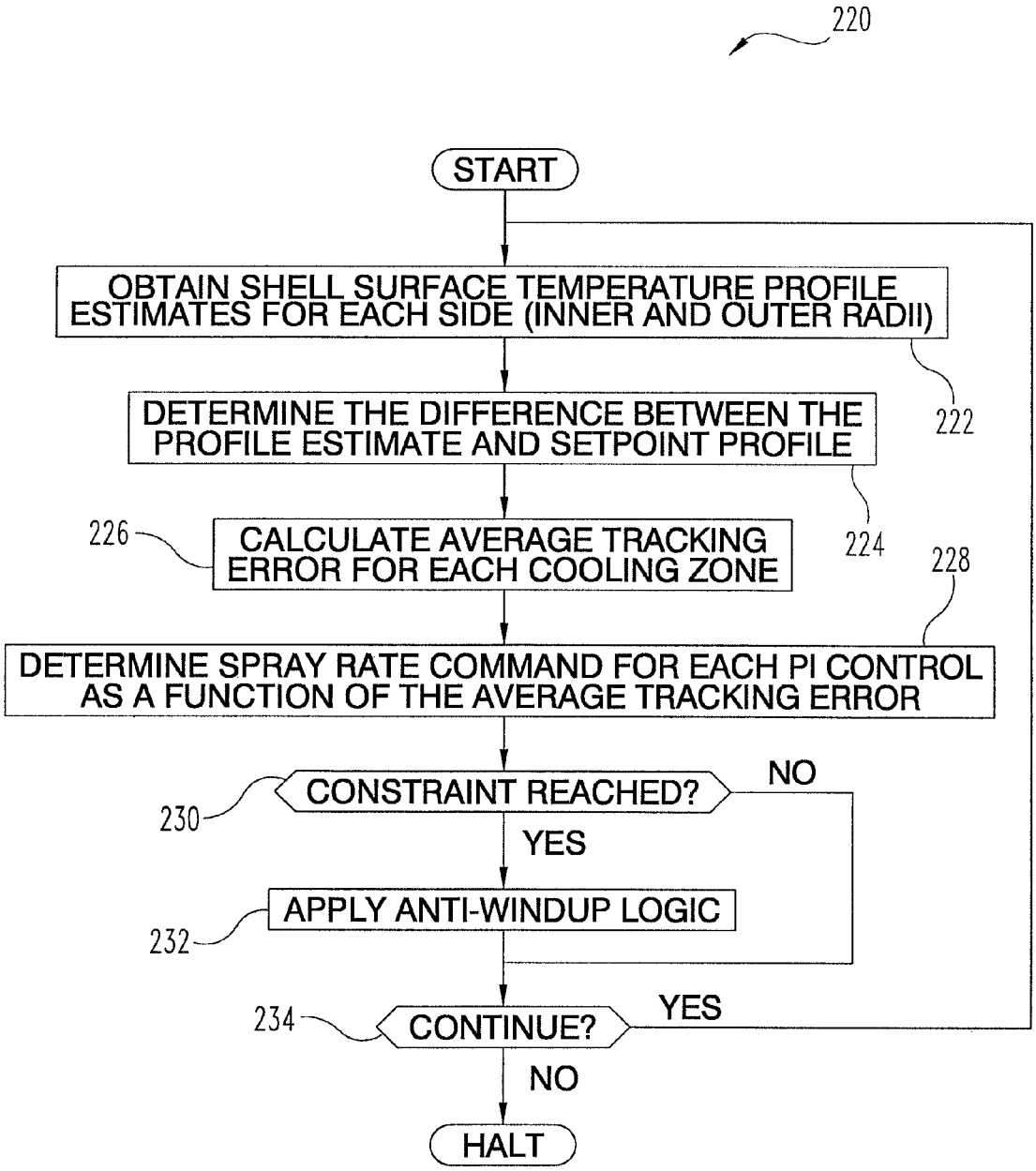
FIG. 6 is a flowchart depicting a procedure for controlling the system of FIG. 1 in accordance with the control system diagram of FIG. 3 using the architecture of FIG. 4.

Referring to FIG. 6, control routine 220 defined by controller program 131 is shown in flowchart form. In operation 222, for each second of time, t, the inner and outer radii shell surface temperature profile estimates/predictions, denoted as $T_{ip}(z,t)$ and $T_{op}(z,t)$, respectively, are obtained from sensor 110 through execution of the CONONLINE program 111. Routine 220 proceeds from operation 222 to operation 224. In operation 224, tracking errors are obtained between surface temperature profile estimates and the shell surface-temperature profile setpoints on the inner and outer radii, $T_{is}(z,t)$ and $T_{os}(z,t)$, respectively, which corresponds to difference operator 134 of FIG. 3. Tracking errors are represented by expression (18) as follows:

$$\Delta T_i(z,t)=T_{is}(z,t)-T_{ip}(z,t)\ \text{and}\ \Delta T_o(z,t)=T_{os}(z,t)-T_{op}(z,t) \tag{18}$$

From operation 224, operation 226 is executed in which the average tracking error for each zone is calculated according to expressions (19) and (20) as follows:

$$\Delta T_i^j(t)=\frac{\int_{zone\ ji}(T_{is}(z,t)-T_{ip}(z,t))dz}{\int_{zone\ ji}dz},\quad j=1,2,\ldots,7 \tag{19}$$

$$\Delta T_o^j(t)=\frac{\int_{zone\ jo}(T_{os}(z,t)-T_{op}(z,t))dz}{\int_{zone\ jo}dz},\quad j=1,2,\ldots,7 \tag{20}$$

Operation 226 of routine 220 corresponds to operation 136 depicted in controller 130, of FIG. 3. Routine 220 continues with operation 228, in which spray rate commands, $r_j(t)$, j=1, 2, . . . , 10, are calculated for each control using the PI control law. The spray rate command calculations are performed in accordance with expressions (21)-(27) as follows:

$$r^j(t)=k_p^j[\Delta T_i^j(t)+\Delta T_o^j(t)]+k_i^j\int_0[\Delta T_i^j(\tau)+\Delta T_o^j(\tau)]d\tau,\quad j=1,2,3,4. \tag{21}$$

$$r^5(t)=k_P^5\Delta T_o^5(t)+k_I^5\int_0\Delta T_o^5(\tau)d\tau, \tag{22}$$

$$r^6(t)=k_P^6\Delta T_i^5(t)+k_I^6\int_0\Delta T_i^5(\tau)d\tau, \tag{23}$$

$$r^7(t)=k_P^7\Delta T_o^6(t)+k_I^7\int_0\Delta T_o^6(\tau)d\tau, \tag{24}$$

$$r^8(t)=k_P^8\Delta T_i^6(t)+k_I^8\int_0\Delta T_i^6(\tau)d\tau, \tag{25}$$

$$r^9(t)=k_P^9\Delta T_o^7(t)+k_I^9\int_0\Delta T_o^7(\tau)d\tau, \tag{26}$$

$$r^{10}(t)=k_P^{10}\Delta T_i^7(t)+k_I^{10}\int_0\Delta T_i^7(\tau)d\tau, \tag{27}$$

where $k_P^j$ and $k_I^j$, j=1, 2, . . . , 10, are the proportional and the integral gains, respectively, for each control. In FIG. 3, the proportional operator, P, is designated by reference numeral 138 and the integrator, I, is designated by reference numeral 140, which includes a standard difference calculation with the output (not shown). The outputs of operators 138 and 140 are summed by operator 142 in FIG. 3.

The operating logic of controller program 131 further includes constraint handling. In particular, this logic provides reliable and stable operation under cooling spray actuator saturation, i.e. in the regime where spray rates are at their maximum and can no longer react to a command that demands further rate increase. For this purpose, anti-windup logic has been adopted to avoid integrator windup should the transient control commands become negative or exceed the maximum spray rates. Accordingly, routine 220 proceeds from operation 228 to conditional 230. Conditional 230 tests whether such a constraint has been reached. If the test of conditional 230 is affirmative (yes), then operation 232 is executed in which the anti-windup logic is applied. In one implementation of this operation, if $r^j(t)<0$, then a modified spray rate control command $r_m^j(t)$ is used in place of $r^j(t)$ and given in the Laplace domain by $$r_m^j(s) = \frac{s}{s+\alpha_j} r^j(s),$$

where $r_m^j(s)$ and $r^j(s)$ are the Laplace transforms of $r_m^j(t)$ and $r^j(t)$, respectively, and $\alpha_j$ is the anti-windup tuning parameter for controller j. On the other hand, if $r^j(t)>r_{u\ lim}^j$, where $r_{u\ lim}^j$ is the upper limit for controller j, Then $$r_m^j(s) = \frac{s}{s+\alpha_j} r^j(s) + \frac{\alpha_j}{s+\alpha_j} r_{u\ lim}^j$$

replaces $r^j(s)$. From operation 232, routine 220 continues with conditional 234 which tests whether to continue the operation of controller program 131. If the test of conditional 234 is positive (yes), routine 220 loops back, returning to repeat operation 222 based on the appropriate time interval (such as 1 second in the experimental example). If the test of conditional 234 is negative (no), then routine 220 halts. Returning to conditional 230, if its test is negative (no), then operation 232 is bypassed by routine 220, which proceeds directly to conditional 234. Referring to FIG. 3, the output of operator 142 is input to operator 144, which represents the application of anti-windup processing, such as that caused by saturation. The spray rate commands from operator 144 are provided to caster 20, and also are provided to prepare a difference signal input to the integrator 140 shown in FIG. 3.

Next, flow rates across the strand width are determined. for cases where separate actuation is available for different cooling fluid discharge devices, or groups of devices, that comprise different cooling zones across the strand width. Generally, cooling can be maintained constant across the strand width, owing to the high aspect ratio of slab. However, in order to avoid over-cooling of the strand corners, the flow rates of nozzles located near the strand corners are adjusted downward using a proportionality factor that varies according with the strand width, and other casting conditions. This approach enables the system to provide flow-rate values to the level I system for each and every independent spray zone.

The shell surface temperature profile setpoint is the desired shell surface temperature profile, which often changes with the grade/composition of strand 60. Previous theoretical knowledge about optimizing spray cooling has been defined in terms of desired temperature profiles at steady state casting conditions. Plant experience is defined by a set of spray water setpoints that are known by empirical means to avoid problems. To combine these two types of knowledge, surface temperature profile setpoints are generated by running the CON1D model at a given casting speed with a good set of spray rates, and applying the same resulting surface temperature profile as the setpoint for all casting speeds. Taking 3.56 m/min as a typical successful casting speed, temperature setpoints were obtained for 8 different spray patterns, each defined by a set of spray rates at 3.56 m/min and corresponding to a set of grades for that pattern.

Typically, it is desired to maintain the temperature profile setpoint for a given steel grade in order to avoid the thermal stresses caused by changing temperature gradients and to avoid the steel ductility troughs associated with particular temperature ranges. Both of these factors help to avoid cracks, even through casting condition changes, startup, and tailout. This approach can be successful in part because steel thermal properties are relatively independent of steel grade and casting speed. Fixing the temperature setpoint below mold 30 can result in sharp changes to the spray rates and corresponding shell surface temperature—especially in the first 2 spray zones below mold 30. By accounting for mold heat flux variations, such fluctuation can be reduced, such that temperature profile setpoints can be chosen to vary with mold heat flux, and consequently also with mold exit temperature.

In this approach, each setpoint is generated as follows. First, the expected mean mold heat flux $Q_{mold0}$ is estimated as a function of mold powder and casting speed, as defined in expression (28) as follows:

$$Q_{mold0} = 4.63\cdot 10^6 \mu^{-0.09} T_{flow}^{-1.19} V_C^{0.47}\left\{1-0.152\exp\left[-\left(\frac{0.107-\%\ C}{0.027}\right)^2\right]\right\} \quad (28)$$

where:

$Q_{mold0}$ is the mean mold heat flux (MW/m$^2$), $\mu$ is the powder viscosity at 1300° C., (Pa·s), $T_{flow}$ is the melting temperature of the mold flux (° C.), $V_c$ is the casting speed (m/min), and % C is the carbon content.

This expression is described in Cicutti, C., MartinValdez, T. Perez, G. DiGresia, W. Balante and J. Petroni, "Mould Thermal Evaluation in a Slab Continuous Casting Machine", Steelmaking Conference Proceedings. Vol. 85 (2002), 97-107, which is hereby incorporated by reference in its entirety. However, other empirical expressions to estimate $Q_{mold}$ as a function of grade and casting conditions are readily available and could be substituted.

Figure 13:
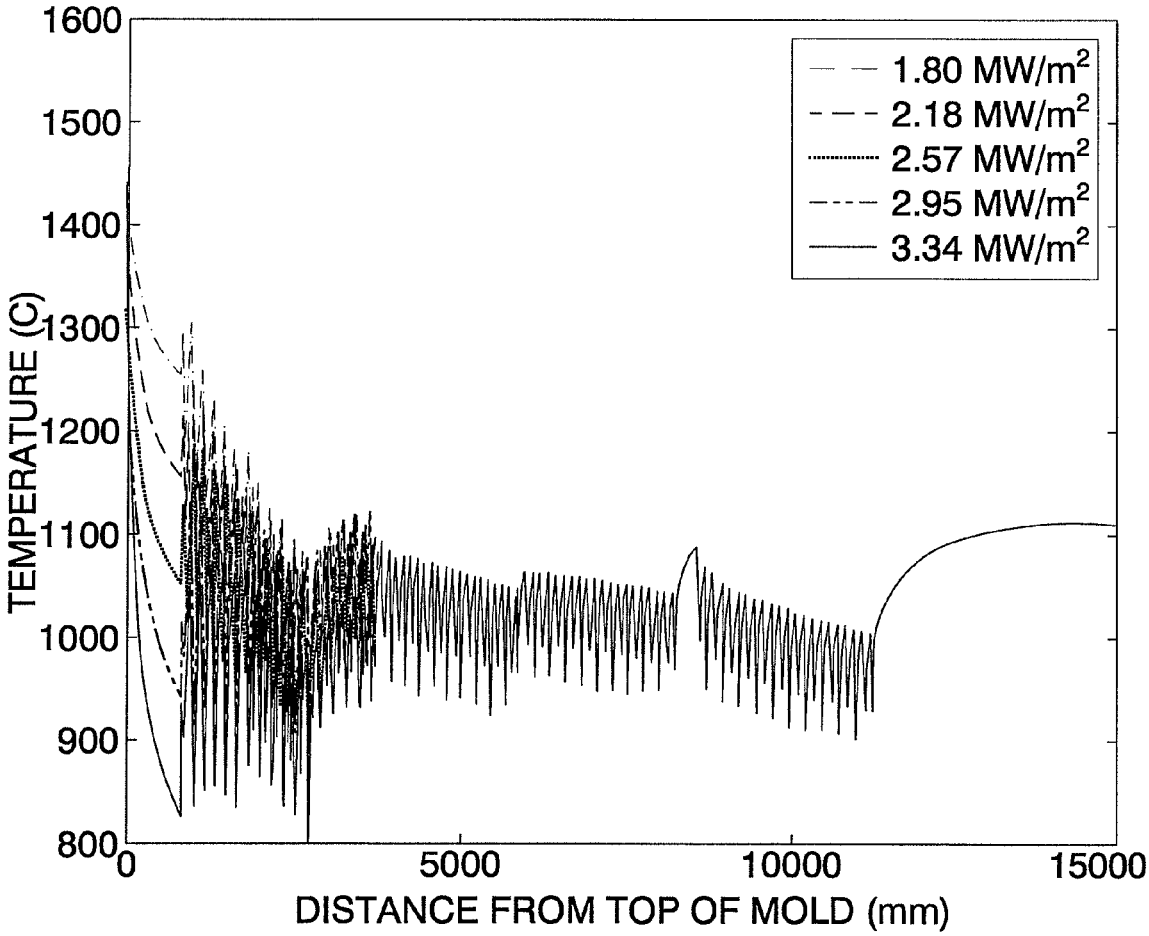
FIG. 13 is a comparative graph of zone-average surface temperature histories extracted from virtual software sensor predictions in the last two spray zones of the caster of FIG. 1 by the control system of FIG. 3 during a sudden drop in casting speed from 3.5 m/min to 3.0 m/min (at t=0).

Then, for spray zones 1-4, five different temperature profile setpoint curves are generated using the CON1D model with 70% $Q_{mold0}$, 85% $Q_{mold0}$, 100% $Q_{mold0}$, 115% $Q_{mold0}$, and 130% $Q_{mold0}$. The effect of mold heat flux variations diminishes with distance down strand 60, so the temperature setpoint for the remaining zones 5 through 7 uses the original fixed setpoint corresponding with $Q_{mold0}$. The 5 temperature setpoint curves for spray pattern 1 are shown in FIG. 13.

Figure 14:
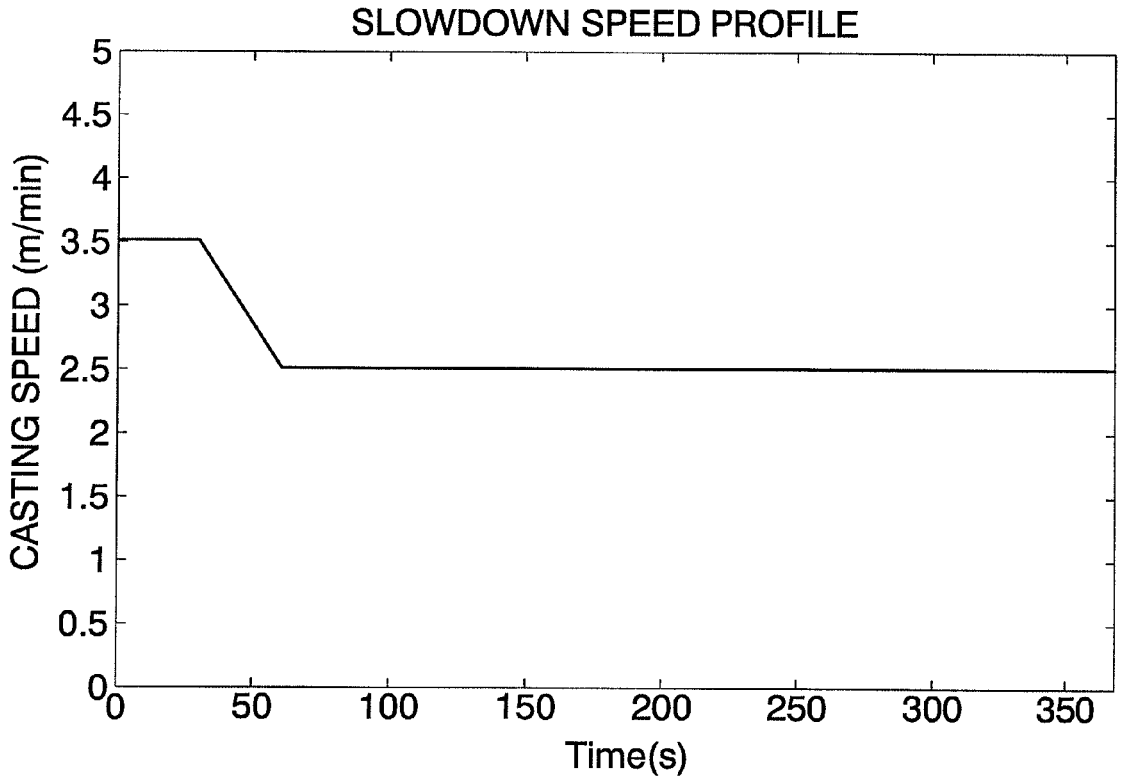
FIG. 14 is a graph depicting a caster speed change.

It can be seen that these setpoints produce mold exit temperature ranging from 850~1250° C. for this example operation. For a particular mold heat flux, or mold exit temperature, interpolation is used to generate a temperature setpoint profile from the setpoints in FIG. 14 such that the predicted mold exit temperature is equal to the mold exit temperature setpoint. This interpolation is represented by operation 132 in the FIG.

3 depiction of controller 130. The impact of mold heat flux variation is thus more evenly distributed over the first 4 spray zones to reduce the chance of occurrence of any abrupt spray rate and corresponding surface temperature changes.

Figure 15:
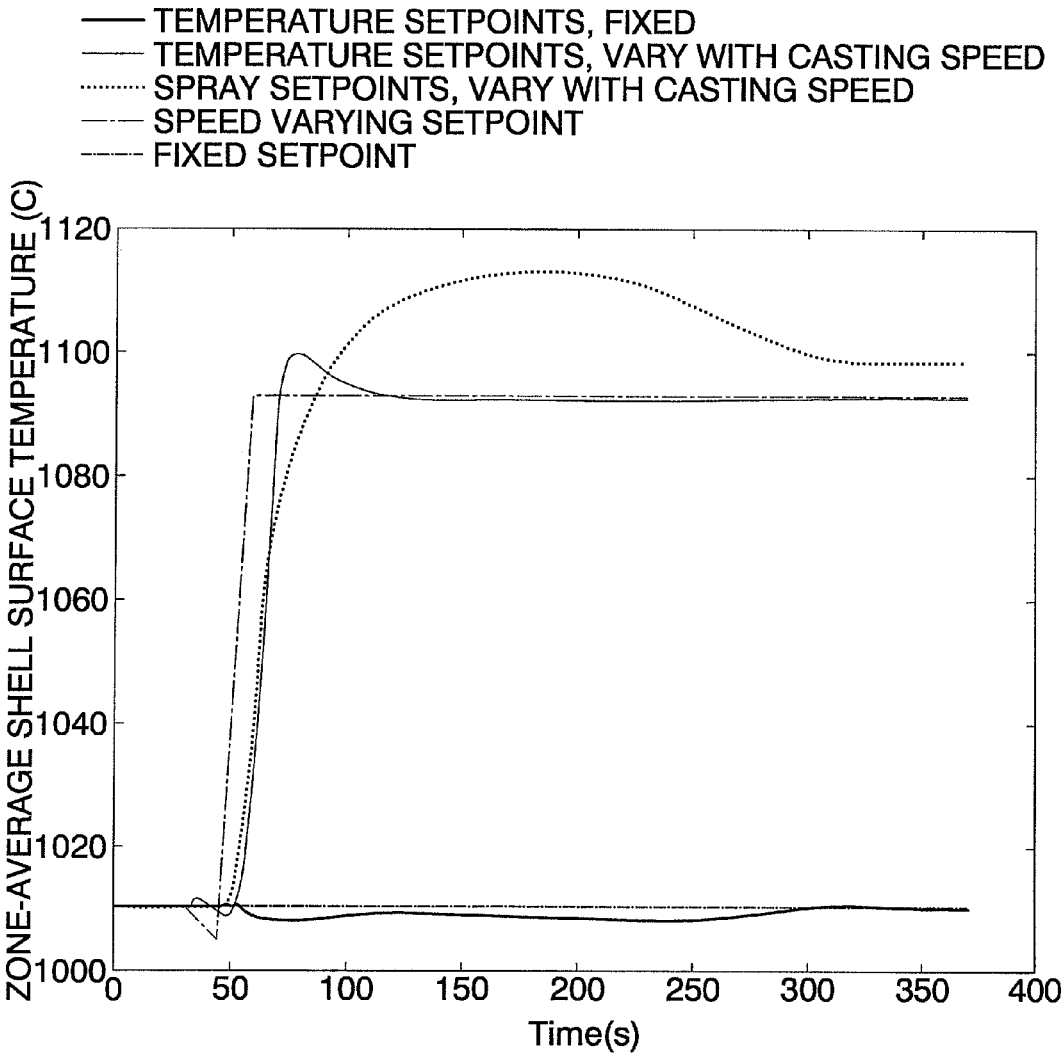
FIG. 15 is a comparative graph depicting zone-average shell surface temperature in the last spray zone relative to selected setpoint conditions.

Thus, the temperature profile setpoints used by control system 112 are organized in a three-dimensional array. The setpoints change with the spray pattern chosen by the operator, the casting speed, and the predicted shell surface temperature at mold exit. However, the setpoints need not vary in this manner during operation. It is possible, for example, to use a constant setpoint over all casting speeds. FIG. 15 compares the performance of three possible setpoint methodologies, using spray rates directly from the spray profile, speed-varying temperature setpoint, and speed-constant temperature setpoint, during a sudden slowdown in casting speed as plotted in FIG. 14. It should be appreciated that the constant temperature setpoint enforces lower temperature gradients in the steel than the other methods. For this reason, setpoints are currently set by choosing a common casting speed, typically around 3.5 m/min, and using the temperature profile setpoint corresponding to that speed as the constant setpoint.

Figure 16:
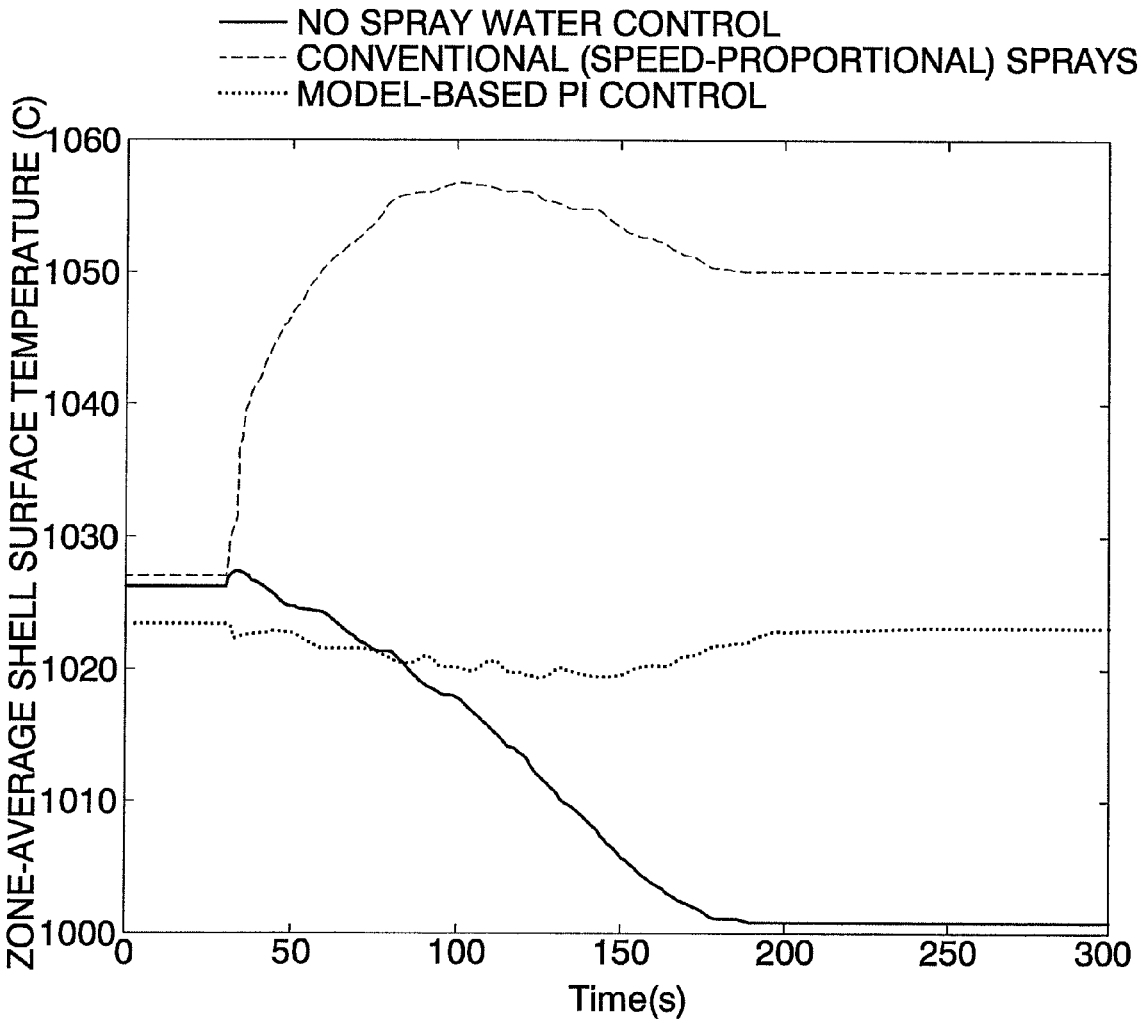
FIG. 16 is a comparative graph depicting zone-average shell surface temperature for spray zone 6 versus time for selected cooling control conditions.
Figure 17:
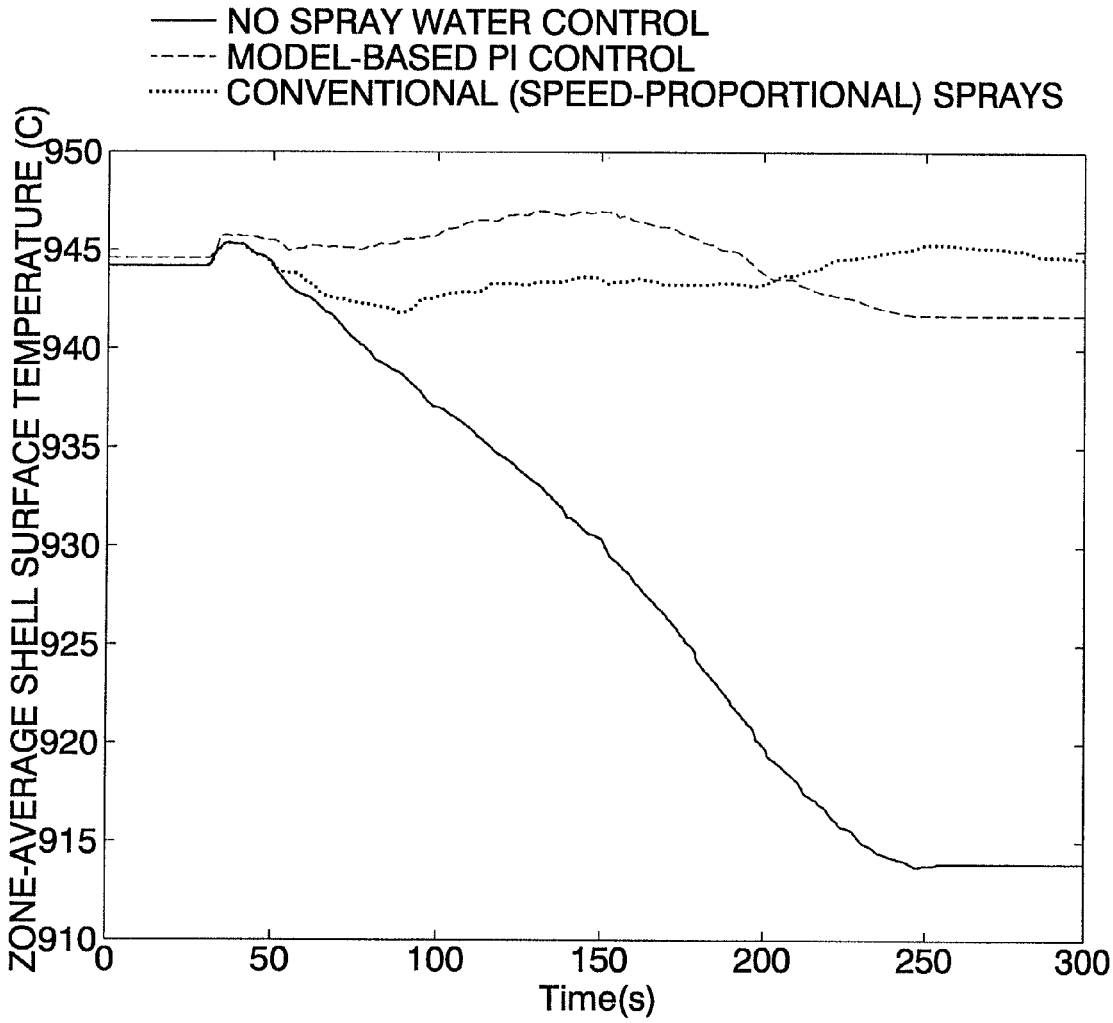
FIG. 17 is a comparative graph depicting zone-average shell surface temperature for spray zone 7 versus time for selected cooling control conditions.

The model and controller programs can be used to simulate the caster response to scenarios involving changing casting conditions. Using the monitor program 192, these simulations can be viewed graphically in real-time. Performance of control system 112 has been evaluated in this manner—especially in comparison to a conventional control system that fixes spray water flow rates with casting speed. For example, FIGS. 16 and 17 compare the zone-average surface temperature histories extracted from virtual sensor 110 predictions in the last two spray zones (zones 6 and 7) of caster 20 ($\Delta T_6$ and $\Delta T_7$) during a sudden drop in casting speed from 3.5 m/min to 3.0 m/min (at t=0). The simulations were run for 0.048% carbon steel. To improve visibility, the particular points are chosen to have decreasing temperature with distance down caster 20. The initial increase in temperature at t=0 in the graphs is due to a decrease in the mold heat removal rate from 2.55 $MW/m^2$ at the higher casting speed to 2.37 $MW/m^2$ at the lower speed. In the online mode for architecture 120, the control system receives mold heat flux data from caster 20 every second. In the offline mode used to produce these simulations, the system estimates this data based on the casting speed using the equation given above.

With no controller, spray water flow rates remain constant with time, so the decrease in casting speed causes higher heat extraction at any given distance down the caster, and the surface temperatures all eventually drop. The time delay for the transition to the new lower steady state temperature varies with distance down the caster. Steady state is not reached until steel starting at meniscus 26 at time t=0 finally reaches the given point in caster 20 after being cast entirely under the new conditions. Thus, points near to the mold exit react quickly to the change, while points lower in caster 20 are affected by the changing upstream temperature history for a long time.

With a controller that increases spray water in proportion to casting speed, the temperature response varies in time, magnitude, and direction. Compared with the original temperatures, the new steady-state temperatures at long times are sometimes lower (eg. at 1 m), sometimes higher (eg. 2 m and 5 m), and sometimes almost the same (11.2 m), depending on how well the proportional drop in water flow compensates for the actual drop in heat extraction. Moreover, the temperature change is sudden, as the sudden large change in spray water takes immediate effect, causing sharp temperature gradients and stress. Indeed, temperature overshoots, because strand 60 is too hot for the lower water flow rates. Eventually, the temperature drops to reach steady state, with a time delay similar to that when no controller is used.

With controller 130, the temperature transition is much smoother. The magnitude of the decrease in spray water flow rates is controlled to vary with spray zone Z, in accordance with the changes in heat extraction predicted by the CONONLINE program 111. Moreover, the changes in water flow with devices 50 are applied gradually, according to the local position, which avoid abrupt, undesirable changes in temperature. The result is a more constant temperature with time, neglecting the numerical anomalies that are not experienced by strand 60.

One nonlimiting invention of the present application includes a method, comprising: producing a metallic strand from molten metal with continuous casting equipment, the casting equipment including a fluid cooled mold, a number of rolls and a number of cooling devices each operable to output a fluid to cool the strand; controlling each respective one of the cooling devices, which includes: (a) providing a target temperature; (b) determining a temperature estimate as a function of heat removal from the mold, temperature of the molten metal input to the mold, and flow rate of the respective one of the cooling devices; and (c) regulating operation of the respective one of the cooling devices as a function of the target temperature and the temperature estimate. Further aspects of this method optionally include the metallic strand comprising steel, the regulating operation for each of the cooling devices being of a closed-loop, or feedback, type (with proportional-integral or any other control law), and/or the temperature estimate being a further function of chemistry of the molten metal and casting equipment geometry. Further inventions include systems, devices, apparatus, and operating logic executable by computational equipment to perform the method.

Another nonlimiting invention includes apparatus, comprising: continuous casting equipment including a fluid cooled mold to produce a metallic strand, a number of rolls, and a number of cooling devices each operable to output a fluid to cool the strand; and processing equipment structured with a closed-loop, or feedback, controller (based on a proportional-integral or any other control law) as a function of heat removal from the mold, temperature of the molten metal input to the mold, flow rate of the respective one of the cooling devices, and a target temperature. Optionally, further inventive aspects include the metallic strand comprising steel and/or the temperature estimate further being a function of chemical composition of the molten metal and casting equipment geometry. Further inventions include methods of using and methods of operating such apparatus.

Still another nonlimiting invention of the present application is directed to a system, comprising continuous casting equipment including a fluid cooled mold to produce a metallic strand, a number of rolls, a number of cooling devices each operable to output a fluid to cool the strand, and means for controlling each respective one of the cooling devices, in which the controlling means includes: means for providing a target temperature; means for determining a temperature estimate as a function of heat removal from the mold, temperature of the molten metal input to the mold, and flow rate of the respective one of the cooling devices; and means for regulating operation of the respective one of the cooling devices as a function of the target temperature and the temperature estimate. Further inventions include methods of using and methods of operating such apparatus.

Many other embodiments of the present invention are envisioned. In one example, the software sensor of the present application is used in conjunction with actual sensors to develop a comprehensive control model that is both robust and accurate. In another example, the control system is adapted to continuous casting of a nonsteel metallic alloy. In still another example of an alternative embodiment, the spray cooling control according to control system 112 is applied to thick slab continuous casters.

A further embodiment of the present application includes: applying molten metal to a continuous casting mold; as the molten metal solidifies in the mold, directing a metal strand received from the mold along a cooling pathway; from time-to-time, taking a measurement representative of heat transfer through the mold as the metallic strand advances from the mold; providing a plurality of different cooling fluid discharge devices at different positions along the pathway to provide a plurality of different strand cooling zones; for each one of the different strand cooling zones, adjusting a respective zone estimate representative of strand temperature in response to a change in the measurement; and for each one of the cooling fluid discharge devices, regulating operation as a function of the respective zone estimate and a respective target value.

Another embodiment includes: a continuous casting mold, means for supplying molten metal to the mold, means for directing a metallic strand received from the mold along a cooling pathway, means for taking a measurement representative of heat transfer through the mold as the metallic strand advances therefrom; a plurality of different cooling fluid discharge devices at different positions along the pathway to provide a plurality of different strand cooling zones; and means for adjusting a respective zone estimate representative of strand temperature in response to a change in the measurement; and means for regulating operation of each one of the cooling fluid discharge devices as a function of the respective zone estimate and a respective target value.

Still, another embodiment comprises: a source of molten metal; a continuous casting mold structured to receive the molten metal from the source; a number of rolls to withdraw a metallic strand along a cooling pathway from the mold; a plurality of different cooling fluid discharge devices at different positions along the pathway to provide a plurality of different strand cooling zones; a sensor providing a signal representative of heat transfer of the mold; a processing device operatively coupled to the cooling fluid discharge devices and the sensor that is responsive to the signal to execute operating logic to determine a plurality of strand temperature estimates as a function of the heat transfer in correspondence to the different cooling zones and generate a plurality of cooling fluid discharge device control signals each as a function of a corresponding one of the estimates and a corresponding one of a number of zone target values; and wherein the cooling fluid discharge devices are each responsive to a respective one of the discharge device control signals to regulate fluid discharge therefrom.

Yet another embodiment includes: applying molten metal to a continuous casting mold; as the molten metal solidifies in the mold, directing a metallic strand received from the mold along a cooling pathway that includes an outer cooling shell with a first side opposite a second side; providing a plurality of different cooling fluid discharge devices at different positions along the pathway to provide a plurality of different strand cooling zones; modeling temperature of the strand for the first side and the second side at each of the number of different points along the pathway; estimating a first shell thickness profile along the pathway for the first side from the modeling and a second shell thickness profile along the pathway for the second side from the modeling; and in response to a difference in the first shell thickness profile and the second shell thickness profile, adjusting operation of one or more of the cooling fluid discharge devices.

Another embodiment includes: a continuous casting mold and a supply of molten metal provided to the mold, means for directing a metallic strand received from the mold along a cooling pathway that has an outer cooling shell with a first shell side opposite a second shell side, a plurality of different cooling fluid discharge devices at different positions along the pathway to provide a plurality of different strand cooling zones, means for modeling temperature of the strand for the first shell side and the second shell side at each of a number of different points along the pathway, means for estimating a first shell thickness profile along the pathway for the first side from the modeling means and a second shell thickness profile along the pathway for the second side from the modeling means, and means for adjusting operation of one or more of the cooling fluid discharge devices in response to a difference in the first shell thickness profile and the second shell thickness profile.

Still another embodiment of the present application is an apparatus comprising: a molten metal, a continuous casting mold structured to receive the molten metal from the source, a number of rolls to withdraw a metallic strand along a cooling pathway from the mold that has an outer cooling shell with a first shell side opposite a second shell side; a plurality of different cooling fluid discharge devices at different positions along the pathway to provide a plurality of different strand cooling zones; and a processing device operatively coupled to the cooling fluid discharge devices that includes operating logic executable to model temperature of the strand for the first side and the second side at each of the number of different points along the pathway and estimate a first shell thickness profile along the pathway from the first side thickness profile and a second shell thickness profile along the pathway for the second side and generate one or more cooling fluid discharge device control signals; and wherein one or more of the cooling fluid discharge devices are responsive to the one or more control signals to adjust operations thereof.

A further embodiment includes: applying a molten metal to a continuous casting mold; as the molten metal solidifies in the mold, directing a metallic strand received from the mold along a cooling pathway; operating a plurality of different cooling fluid discharge devices at different positions along the pathway to provide a plurality of different strand cooling zones; estimating a temperature profile for the strand; and regulating the operation of each of the different cooling fluid discharge devices in accordance with the respective one of a corresponding number of closed-loop, or feedback, controllers (based on a proportional-integral or any other control law) as a function of a desired profile and the estimated/predicted temperature profile.

Yet a further embodiment includes: a continuous casting mold that receives a supply of molten metal from a molten metal source, means for directing the metallic strand received from the mold along a cooling pathway as the molten metal solidifies in the mold, a plurality of different cooling fluid discharge devices at different positions along the pathway to provide a plurality of different strand cooling zones, means for estimating temperature profile for the strand, and means for regulating operation of each of the different cooling fluid discharge devices in accordance with a respective one of a corresponding number of closed-loop, or feedback, controllers (based on a proportional-integral or any other control law) as a function of the desired and the estimated/predicted temperature profiles.

Another embodiment includes an apparatus, comprising: a source of molten metal, a continuous casting mold structured to receive the molten metal from the source, a number of rolls to withdraw a metallic strand along a cooling pathway from the mold, a plurality of different cooling fluid discharge devices at different positions along the pathway to provide a plurality of different strand cooling zones, and a processing device operatively coupled to the cooling fluid discharge devices that includes operating logic executable to regulate operation of each of the different cooling fluid discharge devices in accordance with the respective one of a number of closed-loop, or feedback, controllers (based on a proportional-integral or any other control law) as a function of the desired and the estimated/predicted temperature profiles Still another embodiment comprises: supplying molten metal to a continuous casting mold; as the molten metal solidifies in the mold, directing a metallic strand received from the mold along a cooling pathway where the strand includes an outer cooling shell with a first shell side opposite a second shell side; providing a plurality of different cooling fluid discharge devices at different positions along the pathway to provide a plurality of different strand cooling zones; preparing a strand temperature estimate along the first side and the second side at each of a number of points along the pathway; regulating operation of each of the cooling fluid discharge devices as a function of the strand temperature estimate at each of the different points; and displaying a first profile a varying first shell side thickness relative to first side position along the pathway and a second profile of varying second shell side thickness relative to second side position along the pathway based on the strand temperature estimate at each of the number of different points along the pathway.

Another embodiment includes: a continuous casting mold, a source of molten metal for the mold, a plurality of different cooling fluid discharge devices, means for directing a metallic strand received from the mold along a cooling pathway that includes an outer cooling shell with a first shell side opposite a second shell side, means for preparing a plurality of strand temperature estimate along the first side and the second side at each of a number of different points along the pathway, means for regulating operation of each of the cooling fluid discharge devices as a function of the strand temperature estimate, and means for displaying a first profile of varying first shell side thickness relative to first side position along the pathway and a second profile of varying second shell side thickness relative to second side position along the pathway based on the strand temperature estimates.

In yet another embodiment, an apparatus comprises: a source of molten metal, a continuous casting mold structured to receive the molten metal from the source, a number of rolls to withdraw a metallic strand along the cooling pathway from the mold, a plurality of different cooling fluid discharge devices at different positions along the pathway to provide a plurality of different strand cooling zones, and a processing device operatively coupled to the cooling fluid discharge devices that includes operating logic executable to prepare a number of strand temperature estimates along the first side and the second side at each of a number of different points along the pathway, regulating operation of each of the cooling fluid discharge devices as a function of the strand temperature estimates, and generate a plurality of display signals; and a display responsive to the display signals to provide a first visual profile of varying first shell side thickness relative to first side position along the pathway and a second visual profile of varying second shell side thickness relative to second side position along the pathway based on the strand temperature estimates.

Another embodiment includes: supplying molten metal to a continuous casting mold; as the molten metal solidifies in the mold, directing a metallic strand received from the mold along a cooling pathway; operating a plurality of different cooling fluid discharge devices at different positions along the pathway to provide a plurality of different strand cooling zones; sensing temperature at a number of points along the strand with a plurality of sensors to provide sensed temperature data; calibrating a virtual software sensor temperature profile estimation with the temperature data; and regulating operation of each of the different cooling fluid discharge devices in accordance with the temperature profile estimation after the calibrating of the virtual software sensor.

Yet another embodiment of the present application comprises a continuous casting mold, a source of molten metal for the mold, a plurality of different cooling fluid discharge devices, means for directing a metallic strand received from the mold along a cooling pathway, a plurality of temperature sensors positioned along the pathway to provide temperature data, means for calibrating a virtual software sensor temperature profile estimation with the temperature data, (such as via online analysis of the tracked differences between the temperature sensors and the software sensor during time periods where the temperature sensors were known to be operating accurately), and means for regulating operation of each of the different cooling fluid discharge devices in accordance with the temperature profile estimation using this calibrated virtual software sensor.

A different embodiment, comprises: supplying molten metal to a continuous casting mold; as the molten metal solidifies in the mold, directing a metallic strand received from the mold along a cooling pathway; from time to time, taking measurements representative of heat transfer in the metallic strand which may, for example, be in or near the mold; providing a plurality of different cooling fluid discharge devices at different positions along the pathway to provide a plurality of different strand cooling zones; for each one of the different strand cooling zones, adjusting a respective zone estimate representative of strand temperature in response to a change in the measurements; and for each one of the cooling fluid discharge devices, regulating operation as a function of the respective zone estimate and a respective target value. In one nonlimiting implementation, this embodiment includes flowing a coolant through the mold and the measurements correspond to inlet temperature of the coolant, outlet temperature of the coolant, and flow rate of the coolant. In another nonlimiting implementation, the strand moves along the pathway at least three meters per minute. In another nonlimiting implementation, the strand has a minimum cross-sectional dimension of no more than 100 millimeters. is being inserted.

A further embodiment of the present application comprises: a source of molten metal; a continuous casting mold structured to receive the molten metal from the source; a number of rolls to withdraw a metallic strand along a cooling pathway from the mold; a plurality of different cooling fluid discharge devices at different positions along the pathway to provide a plurality of different strand cooling zones; one or more sensors providing a signal representative of heat transfer in the metallic strand; a processing device operatively coupled to the cooling fluid discharge devices and the sensor, the processing device being responsive to the signal to execute operating logic to determine a plurality of strand temperature estimates as a function of the heat transfer in correspondence to the different cooling zones and generate a plurality of cooling fluid discharge device control signals each as a function of a corresponding one of the estimates and a corresponding one of a number of zone target values; and wherein the cooling fluid discharge devices are each responsive to a respective one of the discharge device control signals to regulate fluid discharge therefrom. One nonlimiting form includes means for flowing a coolant through the mold and the sensors are structured to detect inlet temperature of the coolant, outlet temperature of the coolant, and flow rate of the coolant.

All patents, patent applications, and publications references cited herein are hereby incorporated by reference, each in its entirety. Any theory, mechanism of operation, proof, or finding stated herein is meant to further enhance understanding of the present invention and is not intended to make the present invention in any way dependent upon such theory, mechanism of operation, proof, or finding. It should be understood that while the use of the word preferable, preferably or preferred in the description above indicates that the feature so described may be more desirable, it nonetheless may not be necessary and embodiments lacking the same may be contemplated as within the scope of the invention, that scope being defined by the claims that follow. In reading the claims it is intended that when words such as "a," "an," "at least one," "at least a portion" are used there is no intention to limit the claim to only one item unless specifically stated to the contrary in the claim. Further, when the language "at least a portion" and/or "a portion" is used the item may include a portion and/or the entire item unless specifically stated to the contrary. While the invention has been illustrated and described in detail in the drawings and foregoing description, the same is to be considered as illustrative and not restrictive in character, it being understood that only the selected embodiments have been shown and described and that all changes, modifications and equivalents that come within the spirit of the invention as defined herein or by any claims that follow are desired to be protected.

What is claimed is:

1. A method, comprising:

supplying molten metal to a continuous casting mold;

as the molten metal solidifies in the mold, directing a metallic strand received from the mold along a cooling pathway, the strand including an outer cooling shell;

flowing a coolant through the mold;

from time to time, taking measurements representative of heat transfer through the mold as the metallic strand advances from the mold, the measurements including flow rate of the coolant through the mold, an inlet temperature of the coolant, an outlet temperature of the coolant and a temperature of the molten metal that is supplied to the mold;

providing a plurality of different independently-controllable cooling fluid discharge devices at different positions along the pathway to provide a plurality of different strand cooling zones;

generating a real-time strand temperature estimate along the pathway wherein the strand temperature estimate is established as a function of strand casting speed, the measurements representative of heat transfer through the mold, and the volumetric flow rate of cooling fluid discharged by each one of the different cooling fluid discharge devices;

adjusting the strand temperature estimate in response to a change in at least one of the strand casting speed, the measurements representative of heat transfer through the mold and the respective volumetric flow rates of the cooling fluid discharged by each one of the different cooling fluid discharge devices;

comparing the strand temperature estimate to a desired temperature distribution to determine any differences between the strand temperature estimate and the desired temperature distribution, wherein the desired temperature distribution includes a plurality of temperature setpoints for the shell along the pathway, each setpoint representing a target value;

for each one of the cooling fluid discharge devices, regulating operation as a function of the differences with a closed-loop, feedback controller;

estimating, in real-time, a shell thickness profile along the pathway for the shell and a metallurgical length for the strand based on the strand temperature estimate, and visually displaying a real-time representation of the strand temperature estimate, the shell thickness profile, and the metallurgical length of the strand.

2. The method of claim 1, which includes contacting the strand with a number of rolls and further establishing the strand temperature estimate as a function of heat conduction of each of the rolls.

3. The method of claim 1, wherein the outer cooling shell includes a plurality of sides, the strand temperature estimate includes a temperature profile along a surface of at least one of the plurality of sides of the strand, wherein the shell thickness profile is estimated along at least one of the plurality of sides of the strand.

4. The method of claim 3, wherein the temperature profile is further established as a function of at least one temperature measurement of the cooling fluid and area of the strand upon which the cooling fluid impinges.

5. The method of claim 4, which includes obtaining the at least one temperature measurement with at least one temperature sensor.

6. The method of claim 3, further comprising:

visually displaying simultaneously in real-time the surface temperature profiles and the shell thickness profile along the plurality of sides of the strand.

7. The method of claim 3, wherein the temperature profile is a surface temperature profile of the strand.

8. The method of claim 3, wherein the plurality of sides include an outer radius side and an inner radius side.

9. The method of claim 1, wherein the strand moves along the pathway at least three meters per minute.

10. The method of claim 1, wherein the strand has a minimum cross sectional dimension of no more than 100 millimeters.

11. A method, comprising:

supplying molten metal to a continuous casting mold;

flowing a mold coolant through the mold;

as the molten metal solidifies in the mold, directing a metallic strand received from the mold along a cooling pathway, the strand including an outer cooling shell with a first shell side opposite a second shell side;

directing cooling fluid to the strand from each of a plurality of different independently-controllable cooling fluid discharge devices at different positions along the pathway to provide a plurality of different strand cooling zones;

preparing strand temperature estimates in real time along the first shell side and the second shell side at each of a plurality of points along the pathway as a function of strand casting speed, an inlet temperature of the mold coolant, an outlet temperature of the mold coolant, a flow rate of the mold coolant, a temperature of the molten metal that is supplied to the mold, and the respective volumetric flow rate of the cooling fluid from each of the cooling fluid discharge devices;

estimating in real-time a shell thickness profile along the pathway and a metallurgical length for the strand based on at least one of the strand temperature estimates;

comparing the strand temperature estimates to a desired temperature distribution to determine any differences between the strand temperature estimates and the desired temperature distribution, wherein the desired temperature distribution includes temperature setpoints for the first shell side and the second shell side at the plurality of points along the pathway;

regulating, with a closed-loop feedback controller, operation of each the cooling fluid discharge devices as a function of the differences between the strand temperature estimates and the desired temperature distribution; and visually displaying simultaneously a real-time representation of the strand temperature estimates, the shell thickness profile, and a metallurgical length for the strand.

12. The method of claim 11, wherein the strand moves along the pathway at least three meters per minute.

13. The method of claim 12, wherein the strand has a cross sectional dimension of no more than 100 millimeters.

14. The method of claim 11, which includes:

providing a number of rolls in contact with the strand along the pathway; and determining the strand temperature estimates by accounting for heat loss from the strand caused by the rolls and the cooling fluid from each of the cooling fluid discharge devices.

15. The method of claim 11, further comprising controlling casting speed with a closed-loop, feedback controller based on the differences.

16. The method of claim 11, which includes accounting for one or more constraints of the cooling fluid discharge devices during the regulating of the operation.

17. The method of claim 16, wherein the accounting for the one or more constraints includes anti-windup processing to address a cooling fluid rate limitation.

18. The method of claim 11, wherein the first shell side corresponds to an outer radius side of the strand and the second shell side corresponds to an inner radius side of the strand.

19. The method of claim 11, wherein the strand temperature estimates are strand surface temperature estimates.

20. A method, comprising:

supplying molten metal to a continuous casting mold;

flowing a mold coolant through the mold;

as the molten metal solidifies in the mold, directing a metallic strand received from the mold along a cooling pathway, the strand including an outer cooling shell with an outer radius side and an inner radius side;

providing a plurality of different independently-controllable cooling fluid discharge devices at different positions along the pathway to provide a plurality of different strand cooling zones;

modeling, with a virtual sensor, temperature of the strand for the outer radius side and the inner side at each of a plurality of different points along the pathway to generate real-time strand temperature estimates, wherein the strand temperature estimates are determined as a function of an inlet temperature of the mold coolant, an outlet temperature of the mold coolant, a flow rate of the mold coolant, a temperature of the molten metal that is supplied to the mold, casting speed and the respective volumetric flow rates of the cooling fluid discharge devices;

estimating, in real-time with the virtual sensor, a shell thickness profile along the pathway and a metallurgical length for the strand based on at least one of the strand temperature estimates;

comparing the strand temperature estimates to a desired temperature distribution for the strand to determine any differences between the strand temperature estimates and the desired temperature distribution, wherein the desired temperature distribution includes temperature setpoints for the outer radius side and inner radius side at the plurality of different points along the pathway; and controlling at least one of casting speed and operation of various ones of the independently-controllable cooling fluid discharge devices based on the differences.

21. The method of claim 20, further comprising:

visually displaying simultaneously a real-time representation of the strand temperature estimates, the shell thickness profile, and the metallurgical length of the strand.

22. The method of claim 20, wherein said controlling comprises controlling at least one of casting speed and operation of the one or more of the cooling fluid discharge devices with a closed-loop, feedback controller.

23. The method of claim 20, further comprising:

moving the strand along the pathway at least three meters per minute and the strand has a minimum cross sectional dimension of no more than 100 millimeters.

24. The method of claim 20, further comprising:

providing a plurality of rolls in contact with the strand along the pathway; and determining the temperature profile by accounting for heat loss from the strand caused by the rolls and cooling fluid from each of the cooling fluid discharge devices.

25. The method of claim 20, wherein the strand temperature estimates are strand surface temperature estimates.

* * * * *